US005605582A

United States Patent [19]

Inoue et al.

[11] Patent Number: 5,605,582

[45] **Date of Patent: *Feb. 25, 1997**

[54] ALLOY SHEET HAVING HIGH ETCHING PERFORMANCE

[75] Inventors: Tadashi Inoue; Hidekazu Yoshizawa; Kiyoshi Tsuru; Yoshiaki Shimizu; Tomoyoshi Okita, all of Kawasaki, Japan

[73] Assignee: NKK Corporation, Tokyo, Japan

[ * ] Notice: The portion of the term of this patent subsequent to May 3, 2011, has been disclaimed.

[21] Appl. No.: 153,890

[22] Filed: Nov. 17, 1993

Related U.S. Application Data

[63] Continuation-in-part of Ser. No. 6,802, Jan. 2, 1993, Pat. No. 5,308,723.

[30] Foreign Application Priority Data

| | | | |
|---|---|---|---|
| Jan. 24, 1992 | [JP] | Japan | 4-032939 |
| Jan. 31, 1992 | [JP] | Japan | 5-40714 |
| Jul. 22, 1993 | [JP] | Japan | 5-201879 |
| Aug. 20, 1993 | [JP] | Japan | 5-206628 |

[51] Int. Cl.[6] ..... G03C 5/00

[52] U.S. Cl. ..... 148/320; 148/333; 148/336; 148/442; 420/94; 420/95; 420/581; 430/23

[58] Field of Search ..... 148/320, 310, 148/312, 315, 333, 336, 546, 547, 556, 602, 442; 420/94, 95, 97, 581; 430/23, 323; 445/36

[56] References Cited

U.S. PATENT DOCUMENTS 5,127,965 7/1992 Inoue et al. ..... 148/336

FOREIGN PATENT DOCUMENTS

| | | |
|---|---|---|
| 0104453 | 4/1984 | European Pat. Off. . |
| 0222560 | 5/1987 | European Pat. Off. . |
| 3636815 | 5/1987 | Germany . |
| 62-243782 | 10/1987 | Japan . |
| 1-52024 | 2/1989 | Japan . |
| 2-9655 | 3/1990 | Japan . |
| 2-270941 | 11/1990 | Japan . |

OTHER PUBLICATIONS

Cullity, B. D., Elements of X-Ray Diffraction, 2nd Ed Addison-Wesley Publishing Company, Inc, 1978, pp. 516–517.

*Primary Examiner*—Sikyin Ip

*Attorney, Agent, or Firm*—Frishauf, Holtz, Goodman, Langer & Chick, P.C.

[57] ABSTRACT

An alloy sheet having a pierced hole face and providing a desirable etching performance, comprising {331}, {210}, and {211} planes on the surface; the gathering degree of the {311} plane being 14% or less, the gathering degree of the {210} plane being 14% or less, and the gathering degree of the {211} plane being 14% or less; and the ratio of the gathering degrees expressed by the equation {210}/({331}+{211}) being 0.2 to 1. An alloy sheet having a pierced hole face providing a desirable etching performance, comprising planes of {111}, {100}, {110}, {311}, {331}, {210} and {211}; the gathering degree of the {111} plane, $S_1$, being 1 to 10%, the gathering degree of the {100} plane, $S_2$, being 50 to 94%, the gathering degree of the {110} plane, $S_3$, being 1 to 24%, the gathering degree of the {311} plane, $S_4$, being 1 to 14%, the gathering degree of the {331} plane, $S_5$, being 1 to 14%, the gathering degree of the {210} plane, $S_6$, being 1 to 14%, the gathering degree of the {211} plane, $S_7$, being 1 to 14%; and the ratio of gathering degrees expressed by the equation $(S_2+S_4+S_6)/(S_1+S_3+S_5+S_7)$ being 0.8 to 20.

20 Claims, 9 Drawing Sheets

ETCHING FACTOR $$Ef = \frac{2H}{(d_2 - d_1)}$$

ALLOY SHEET HAVING HIGH ETCHING PERFORMANCE

CROSS REFERENCE TO RELATED APPLICATION

This is a continuation-in-part-application of Ser. No. 08/006,802 filed on Jan. 21, 1993, now U.S. Pat. No. 5,308,723, issued May 3, 1994 which is incorporated herein in its entirety by reference.

BACKGROUND OF THE INVENTION

1. Field of the Invention

The present invention relates to an alloy sheet for electronic devices having high etching performance, and particularly to an alloy sheet suitable for the materials of shadow masks on color cathode ray tubes and of IC lead frames.

2. Description of the Related Arts

Fe—Ni alloys have been used as a material for shadow masks on color cathode ray tubes and for IC lead frames. The Fe—Ni alloys have a significantly low thermal expansion coefficient compared with low carbon steels which have been conventionally used as the materials for electronic devices. For this reason, for example, a shadow mask prepared from Fe—Ni alloy sheet rarely raises a problem of color phase shift caused by thermal expansion even if it is heated by an electron beam.

Fe—Ni alloy sheets used for shadow masks and IC lead frames are subjected to photo-etching process. Conventional Fe—Ni alloy sheets have, however, a disadvantage of inferior etching performance to low carbon steel. In concrete terms, Fe—Ni alloys show considerably poor corrosion to etching liquid and have a large crystal grain size compared with low carbon steels. Consequently, when Fe—Ni alloy sheets are etched to provide pierced holes, the distribution of hole diameters and the hole shape become dispersive. With the disadvantage, Fe—Ni alloy sheets serving as shadow masks tend to generate a blurred periphery on the masks when a light is penetrated through the fine holes prepared by etching. Furthermore, the brightness of masks penetrated by light is poorer than that of masks made of low carbon steels. In particular, high definition masks having fine pitch and fine holes, which have increasingly been requested by the electronics market, likely induce the above described problem which markedly degrades the quality of color cathode ray tubes. In addition, recent color cathode ray tubes strongly demand a high screen brightness, and a inferior mask brightness reduces the competitiveness of products. Regarding the matarials for IC lead frames, the movement toward high density (high integration) of IC demands a fine pitch of the pin arrangement on a lead frame. Since the conventional Fe—Ni alloys have the problems described above, they can not respond to the request for a fine pitch of the pin arrangement. Adding to the problem, conventional Fe—Ni alloys have a disadvantage of inferior performance of plating after etching.

Several technologies to solve the problem on etching performance of Fe—Ni alloys have been proposed. They include the following.

(1) Japanese examined Patent publication No. 2-9665 discloses an alloy sheet having a gathering degree of {100} plane of 35% or more on the surface of sheet as an Invar alloy sheet which realizes high definition and uniform etching.

(2) Japanese unexamined Patent publication No. 62-243782 discloses a method for producing a Fe—Ni Inver alloy which improves etching speed and reduces a blurred periphery of a pierced hole, the alloy having the {100} plane on its surface and a surface roughness of Ra in a range of 0.2 to 0.7 μm and a Sm of 100 μm or less and a crystal grain size number of 8.0 or more.

(3) Japanese unexamined Patent publication No. 2-270941 discloses a method for producing a Fe—Ni Invar alloy which improves etching speed, the alloy having a degree of {200} plane of 50% or more on its surface. The alloy also has 0.007 wt. % or less C, and impurities of 0.005 wt. % or less P and 0.005 wt. % S, the other impurities being 0.10 wt. % or less.

However, the technology of (1) cannot prevent the generation of a blurred periphery on a prepared shadow mask and is inferior in the brightness of the mask to conventional masks made of low carbon steel, though the technology improves the precision and uniformity of etching. The technology of (2) is inferior in the brightness of the prepared shadow mask to that made of low carbon steel, though the etching speed increases and the production of blurred periphery of pierced hole is improved.

The technology of (3) raises a problem of excessive side etching on prepared IC lead frames and of poor processing accuracy as lead frames.

These three technologies the have problem of inferior plating performance of IC lead frames processed by etching. For instance, when an IC lead frame obtained by the technology of (3) is subjected to solder plating, abnormal growth of acicular crystals called "whisker" occurs, which raises a quality problem.

SUMMARY OF THE INVENTION

The object of the present invention is to provide a thin alloy sheet having excellent etching-performance and plating performance.

To achieve the object, the present invention provides an alloy sheet having excellent pierced hole surface, which alloy sheet comprises:

said alloy sheet having {331}, {210}, and {211} planes on a surface thereof;

a gathering degree of the {331} plane being 14% or less, a gathering degree of the {210} plane being 14% or less, and a gathering degree of the {211} plane being 14% or less; and a ratio of gathering degree being from 0.2 to 1, said ratio being given by an equation of {210}/({331}+{211}).

Furthermore, the present invention provides an alloy sheet having a pierced hole surface having excellent etching performance, which alloy sheet comprises:

said alloy sheet having planes of {111}, {100}, {110}, {311}, {331}, {210}, and {211};

said planes, each, having gathering degrees given below:
the degree $S_1$ of the {111} plane: 1 to 10%,
the degree $S_2$ of the {100} plane: 50 to 94%,
the degree $S_3$ of the {110} plane: 1 to 24%,
the degree S4 of the {311} plane: 1 to 14%,
the degree $S_5$ of the {331} plane: 1 to 14%,
the degree $S_6$ of the {210} plane: 1 to 14%,
the degree S7 of the {211} plane: 1 to 14%; and a ratio of gathering degree being from 0.8 to 20, said ratio being given by and equation of $(S_2+S_4+S_6)/(S_1+S_3+S_5+S_7)$.

DESCRIPTION OF PREFERRED EMBODIMENTS

Preferred Embodiment -1

Figure 1:
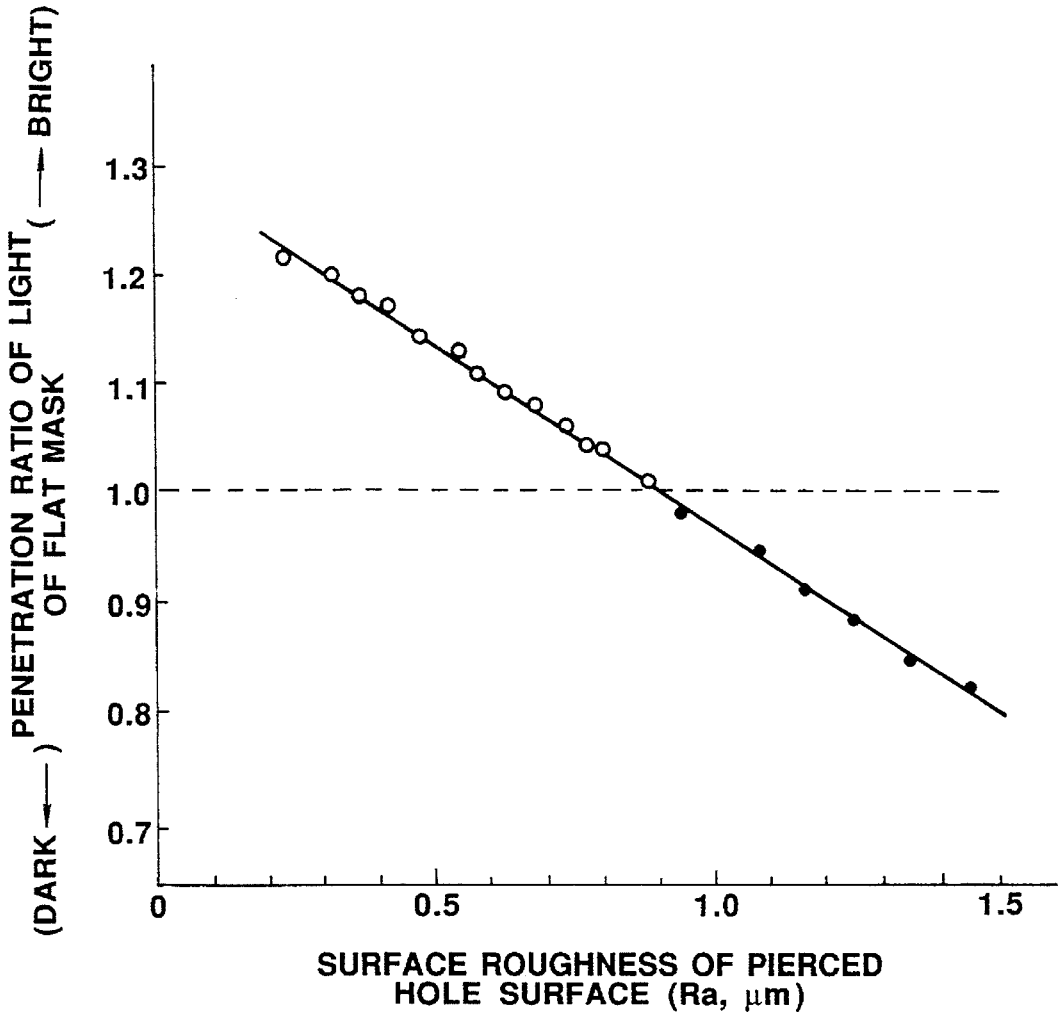
FIG. 1 is a graph showing a relation between penetration ratio of light of a flat mask and surface roughness, Ra, a of pierced hole surface according to the Preferred Embodiment -1.

To prepare etched holes having a uniform size and a uniform shape on the whole surface area of a Fe—Ni alloy sheet, the inventors found that the etching speed shall be kept constant and shall be at a sufficiently high rate on the whole material surface area, and that it is important to increase the etching factor (defined in FIG. 5), and that the increase of the etching factor is effectively performed to a large degree by control of a ratio of gathering degree of specified crystal planes on the etching surface (alloy surface) and by control of a crystal grain size in a thickness direction of the alloy sheet. Furthermore, the inventors found that the control of surface roughness (Ra) on the pierced hole surface to be a specified level or less is important to maintain plating performance after etching and the brightness of a shadow mask at an excellent level, and that such a surface roughness of a pierced hole face is obtained by controlling the gathering degree of specific crystal planes.

The alloy sheets of this invention comprise the components mainly having Fe and Ni, and the components mainly having Fe, Ni and Co and/or Cr. The preferred content of these main component elements and the reason for such content are described below.

An alloy sheet used for the material of shadow masks will now be described.

For the prevention of color phase shift, a Fe—Ni alloy sheet for a shadow mask needs to have $2.0\times(1/10^6)/°C.$ as an upper limit of average thermal expansion coefficient in a temparature range of 30° to 100° C. The thermal expansion coefficient depends on the Ni content of the alloy, and the range of Ni content to give the thermal expansion coefficient described above is 34 to 38 wt. %. Accordingly, the Ni content is preferably limited to a range of 34 to 38 wt. %. To obtain a lower average thermal expansion coefficient than the above specified value, the Ni content is preferably limited to a range of 35 to 37 wt. %, and most preferably to a range of 35.5 to 36.5 wt. %. Generally, Co exists in a Fe—Ni alloy as an inevitable impurity to some extent. A cobalt content of 1 wt. % or less affects very little the characteristics of alloy. The Ni content within the range specified above is satisfactory, but when the alloy contains Co of more than 1 wt. % but 7 wt. % or less, the Ni content which satisfies the above specified level of average thermal expansion coefficient is in a range of 28 to 38 wt. %. Consequently, when the alloy contains Co of more than 1 wt. % but 7 wt. %, or less, the Ni content is preferably in a range of 28 to 38 wt. %. Also 3 to 6 wt. % Co and 30 to 33 wt. % Ni provide a lower average thermal expansion coefficient. When the Co content exceeds 7 wt. %, the thermal expansion coefficient increases. Therefore, the upper limit of Co content is preferably set at 7 wt. %.

Regarding the case of an alloy sheet for IC lead frames, the Ni content which satisfies the condition of an average thermal expansion coefficient requested by a Fe—Ni alloy sheet for an IC lead frame is in a range of 38 to 52 wt. %. The Ni content of less than 38 wt. % or more than 52 wt. % results in an excess value of an average thermal expansion coefficient of the alloy, which then results in a poor compatibility with semiconductor elements, glass, and ceramics. Consequently, the Ni content is preferably limited to a range of 38 to 52 wt. %. As described above, Co exists in a Fe—Ni alloy as an inevitable impurity to some extent, and 1 wt. % or less Co affects very little the characteristics of the alloy, so the acceptable Ni content is in the range described above.

On the other hand, an alloy sheet for IC lead frames enhances the compatibility with semiconductor elements, glass, and ceramics by adding Co of over 1 to 20 wt. % Co. The Co content of 1 wt. % or less or more than 20 wt. % does not attain the effect. When the alloy contains over 1 to 20 wt. % Co, the range of Ni content to satisfy the condition of average thermal expansion coefficient as the material for IC lead frames is 27 to 32 wt. %. The Ni content of less than 27 wt. % or more than 32 wt. % increases the thermal expansion coefficient. Accordingly, when the alloy contains Co of over 1 to 20 wt. %, the preferred Ni content range is 27 to 32 wt. %.

Chromium is an element to improve the mechanical properties, but Cr is an element to degrade thermal expansion characteristics. The upper limit of Cr content to obtain the thermal expansion characteristics aimed by this invention is 3.0 wt. %. Accordingly, Cr is allowed to contain 3.0 wt. % as the upper limit.

The elements other than above described major elements are preferably limited to 0.0050 wt. % or less C, 0.50 wt. % or less Mn, 0.20 wt. % or less Si, 0.0050 wt. % or less N, 0.0050 wt. % or less 0, and 0.0050 wt. % or less B from the viewpoint of securing the characteristics required for the material of IC lead frames.

Next, a gathering degree of planes on the surface of an alloy sheet, a ratio of the gathering degree and an average crystal grain size in a thickness direction of the alloy sheet, which are the most remarkable features of the present invention, will be explained.

The inventors found that the control of the gathering degree of {331}, {210}, and {211} planes on the surface of the alloy sheet having the composition described above and the control of the ratio of the gathering degrees on these planes within a specified range enhance an etching factor effectively, reduce the surface, roughness (Ra) of a piereced hole surface improve the brightness of shadow mask, and improve the plating performance after etching to an excellent level.

FIG. 1 shows a relation between penetration ratio of a flat mask. The flat mask, which an as-etched alloy sheet to make a pierced hole for a shadow mask, produced by photo-etching a Fe—Ni alloy sheet, a Fe—Ni—Co alloy sheet, a Fe—Ni—Cr alloy sheet, and a Fe—Ni—Co—Cr alloy sheet having varied gathering degrees of {331}, {210}, and {211} planes on their surfaces. The penetration ratio of the flat mask was determined by measuring the quantity of light penetrated through the flat mask and by dividing a quantity by the quantity of light penetrated through a flat mask having the same size and being made of low carbon steel. The surface roughness of the pierced hole surface was determined by the method described later in the Examples.

The gathering degree of each plane is determined from each of X ray diffraction intensities of (111), (200), (220), (311), (331), (420), and (422) diffraction planes, which intensity is measured the by X ray diffraction method on the surface of the sheet. For example, the gathering degree of {331} plane is determined by dividing a relative X ray diffraction ratio of (331) diffraction plane by the sum of the relative X ray diffraction intensity ratio of each diffraction plane, (111), (200), (220), (311), (331), (420), and (422). The gathering degrees of (210) plane and (211) plane are also determined by the similar manner. The relative X ray diffraction intensity ratio is defined as a value obtained by dividing X ray diffraction intensity measured on each diffraction plane by a theoretical X ray diffraction intensity on the corresponding diffraction plane. For instance, the relative X ray diffraction intensity ratio on (111) diffraction plane is determined by dividing the X ray diffraction intensity on (111) plane by the theoretical X ray diffraction intensity on (111) diffraction plane.

The gathering degree of {210} plane is determined by dividing the relative X ray diffraction intensity ratio on (420) plane, which has the same orientation with these corresponding crystal planes by the sum of relative X ray diffraction intensity ratio of the seven crystal planes, {111} through {422} described above. The gathering degree of {211} plane is determined by dividing the relative X ray diffraction intensity ratio on {422} plane.

In the plot of FIG. 1, white circles (○) correspond to the degree of 14% or less for, {331} plane, 14% or less for {210} plane, and 14% or less for {211} plane, and the black circles (●) correspond to either one of the degree of above 14% for {331} plane, above 14% for {210} plane, and above 14% for {211} plane.

According to FIG. 1, when the gathering degree of each of {331}, {210}, and {211} planes is 14% or less, the surface roughness, Ra, of a pierced hole surface becomes 0.90 μm or less to raise the penetration ratio of light through the flat mask to 1.0 or more, which gives a brightness higher than that of a conventional flat mask of low carbon steel. As for the plating performance of alloy sheets for IC lead frames after etching, an experiment carried out by the inventors continued that the surface roughness, Ra, becomes to 0.90 or less by controlling the gathering degree of each {331} plane, {210} plane, and {211} plane to 14% or less, which provide an excellent solder plating performance.

If any of the gathering degree of {331} plane, {210} plane, or {211} plane becomes out of the range specified above, the surface roughness, Ra, of the pierced hole surface exceeds 0.90 μm, and the characteristics described above can not be attained. A microscopic observation of such a pierced hole surface of the alloy sheet revealed, that fine pits (irregularity) occurred on the whole surface area. Consequently, that type of pits is presumably responsible for the increase of the surface roughness, Ra, of a pierced hole surface to 0.9μm or more. The effect of other parameters on the relation between the brightness of shadow mask and the surface roughness of pierced hole surface was studied. Among various factors, the center line average roughness (Ra) had the strongest correlation to the relation.

Accordingly, the present invention specifies the gathering degree of each of {331}, {210}, and {211} planes to be 14% or less as the condition to attain an excellent level of brightness of flat masks and an excellent plating performance after etching.

Figure 2:
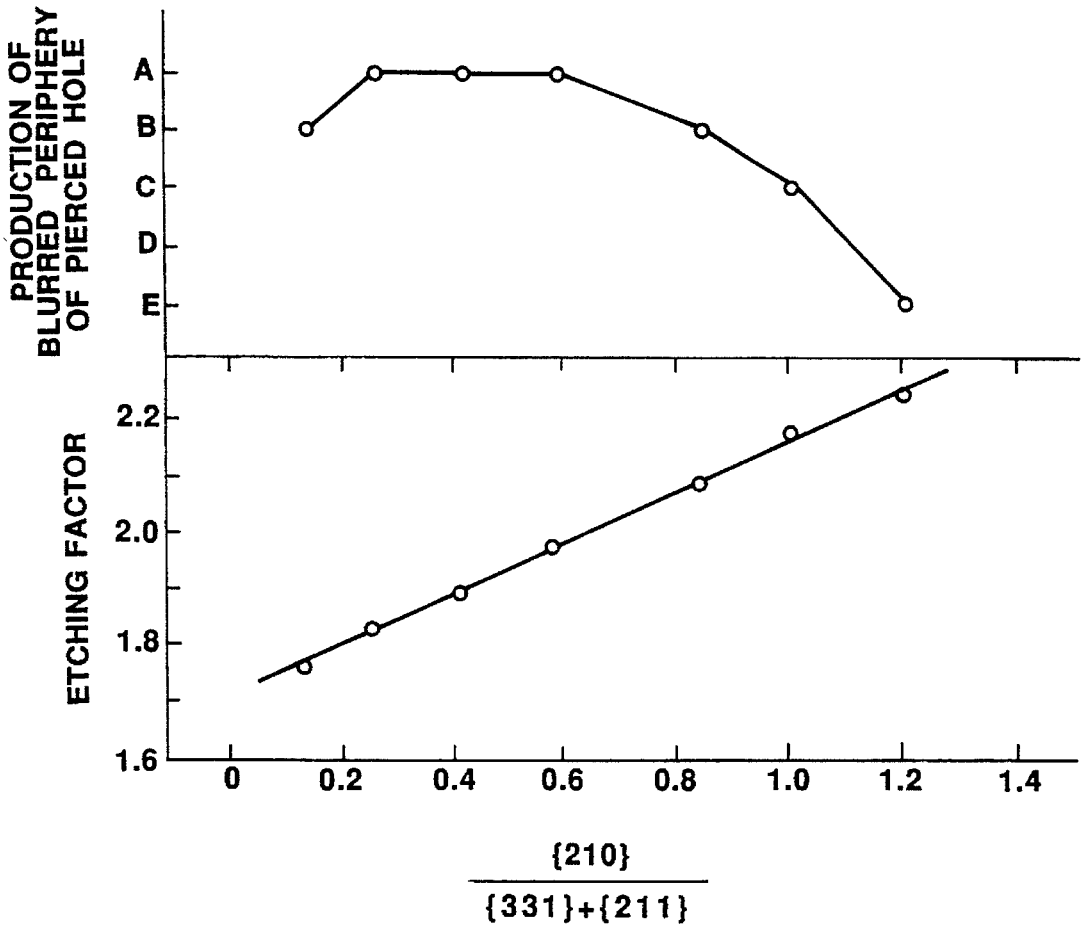
FIG. 2 is a graph showing a relation among ratio of gathering degree on each {331}, {210}, and {211} plane on an alloy surface, {210}/({331}+{211}), an etching factor, and production of a blurred periphery of a pierced hole on flat mask according to the Preferred Embodiment -1.

For an effective improvement of etching factor, the control of the ratio of gathering degree of each plane of {331}, {210}, and {211} on the surface of alloy sheet is necessary. FIG. 2 shows a relation between a ratio of a gathering degree on each {331}{210} and {211} plane on an alloy sheet and an etching factor and a relation between the ratio of the gathering degree and production of the blurred periphery of a pierced surface on a flat mask. The alloy sheets are photo-etched and are a Fe—Ni alloy sheet, a Fe—Ni—Co alloy sheet, a Fe—Ni—Cr alloy sheet and a Fe—Ni—Co—Cr alloy sheet. The alloy sheets have the gathering degrees within the range of this invention and have various ratios of the gathering degrees, the ratio being given by the equation of {211}/{210}+{211}.

This invention specifies the etching factor as a value of 1.8 or higher which raises no practical problem. The gathering degree of each plane of {311}, {210}, and {211} was determined by the X ray diffraction method described above, and the etching factor was determined by the same procedure described in the Examples which will be given later. The production of a blurred periphery of a pierced hole was determined by visual observation in accordance with the judgement standard given below.

A: no production of a blurred periphery of a pierced hole is observed.

B: slight production of a blurred periphery of a pierced hole is found but substantially no problem occur in practical use.

C: production of a blurred periphery of a pierced hole is found to some extent but no problem occur in practical use.

D: production of a blurred periphery of a pierced hole appears to raise a problem in practical use.

E: marked production of a blurred periphery of a pierced hole appears and a problem occurs in practical use.

The grades A through C give no problem in practical use.

According to FIG. 2, the increase of the value of {210}/({331}+{211}) increases the value of the etching factor, and when this value becomes 0.2 or more, the eching factor becomes 1.8 or more value. On the other hand, when the value of {210}/({331}+{211}) exceeds 1.0, the production of a blurred periphery of a pierced hole becomes worse and problems arise on practical application. Consequently, this invention specifies the value of {210}/({331}+{211}) to be in a range of 0.2 to 1.0 so as to attain a low production of a blurred periphery of a pierced hole and a high etching factor, which is aimed by this invention. The value ranges more preferably from 0.25 to 0.6 since the production of a blurred periphery of a pierced hole does not appear.

Thus, the control of the ratio of gathering degree of specific planes on the surface of an alloy sheet effectively increases the value of the etching factor. Nevertheless, for further improvement of the etching factor, it is also effective to limit an average crystal grain size in a thickness direction of the alloy sheet. The Japanese unexamined patent publicaton No. 2-243782 (the prior art (2) described before) specifies the grain size to be No. 8.0 or more size number. However, the size number described in the patent specification is only No. 10.0 at the minimum, that is 11 μm (from the calculation of [crystal grain size number]=16.6439–6.6439 log ([average crystal grain size]/1.125)). In contrast thereto, an alloy sheet of this invention which is controlled by the gathering degree of specific planes and by the ratio of the degree further improves the etching factor by reducing the average crystal grain size in the thickness direction of sheet to be 10 μm or less (10.3 or more crystal grain size number) which is smaller than the level of the prior art given above.

Figure 3:
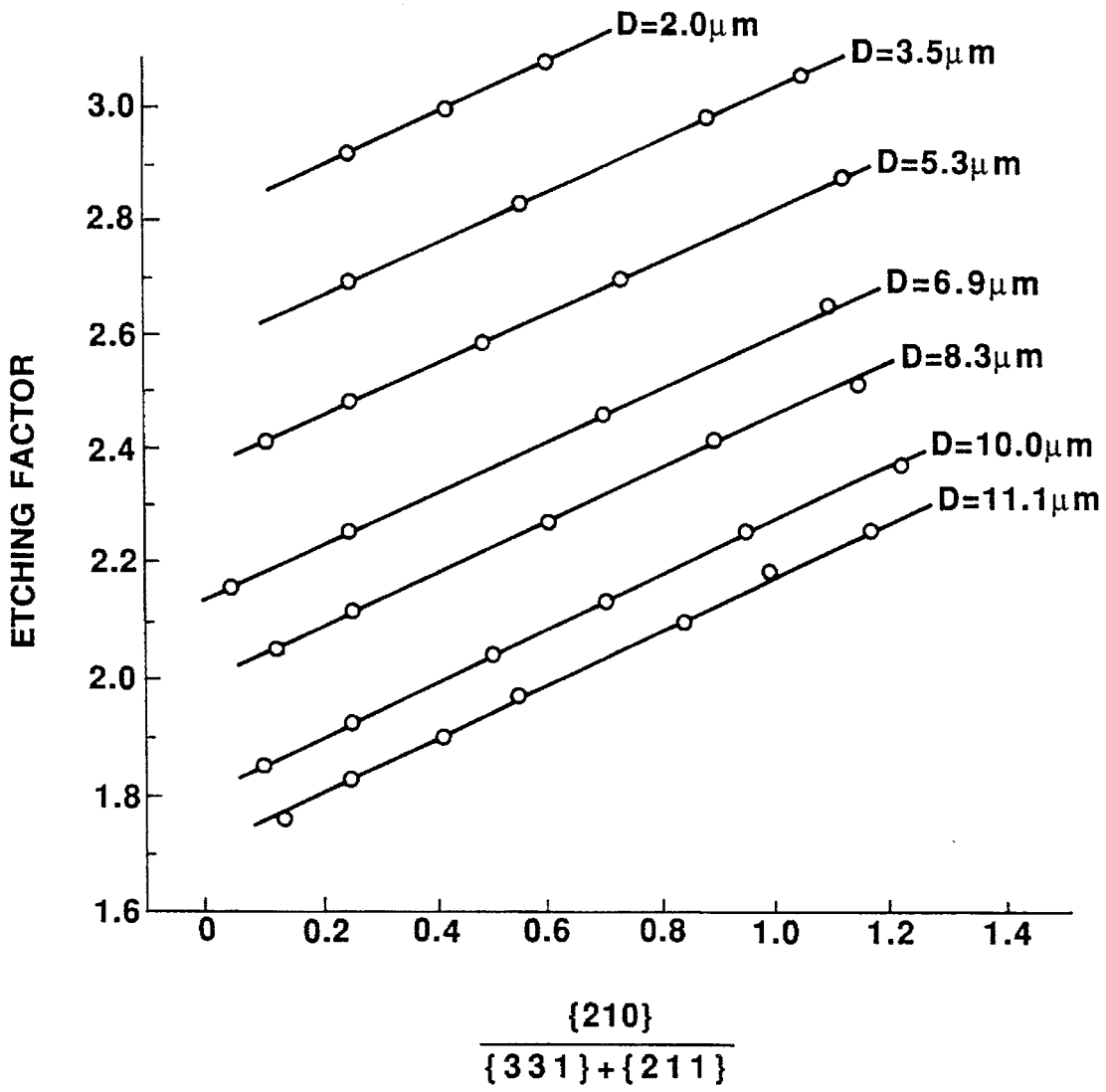
FIG. 3 is a graph showing the effect of an average crystal grain size in a thickness direction of an alloy sheet and the ratio of gathering degree of each {331}, {210}, and {211} plane on the alloy surface, {210}/({331}+{211}), on the etching factor according to the Preferred Embodiment -1.

FIG. 3 shows the effect of the value of {210}/({331}+{211}) and the average crystal grain size which is given on the etching factor of an Fe—Ni alloy sheet, an Fe—Ni—Co alloy sheet, an Fe—Ni—Cr alloy sheet, and an Fe—Ni—Co—Cr alloy sheet which were photo-etched in advance and which have 14% or less of gathering degree of each {331} plane, {210} plane, and {211} plane and which have different average crystal grain size in the thickness direction of the alloy sheet. According to FIG. 3, even under the same value of {210}/({331}+{211}), a finer average crystal grain size gives a higher etching factor. When the average grain size exceeds 10μm, the etching factor decreases to 1.8 or less at 0.2 of the value of {210}/({331}+{211}). However, when the average grain size is kept at 10 μm or smaller, the etching factor exceeds 1.8 even if the value of {210}/({331}+{211}) is 0.2. Consequently, it is preferable to limit the average crystal grain size in the thickness direction of the sheet to 10 μm or less for to further increase the etching factor. If the average crystal grain size is 6 μm or less, the etching factor is still further increased in the range.

Figure 4:
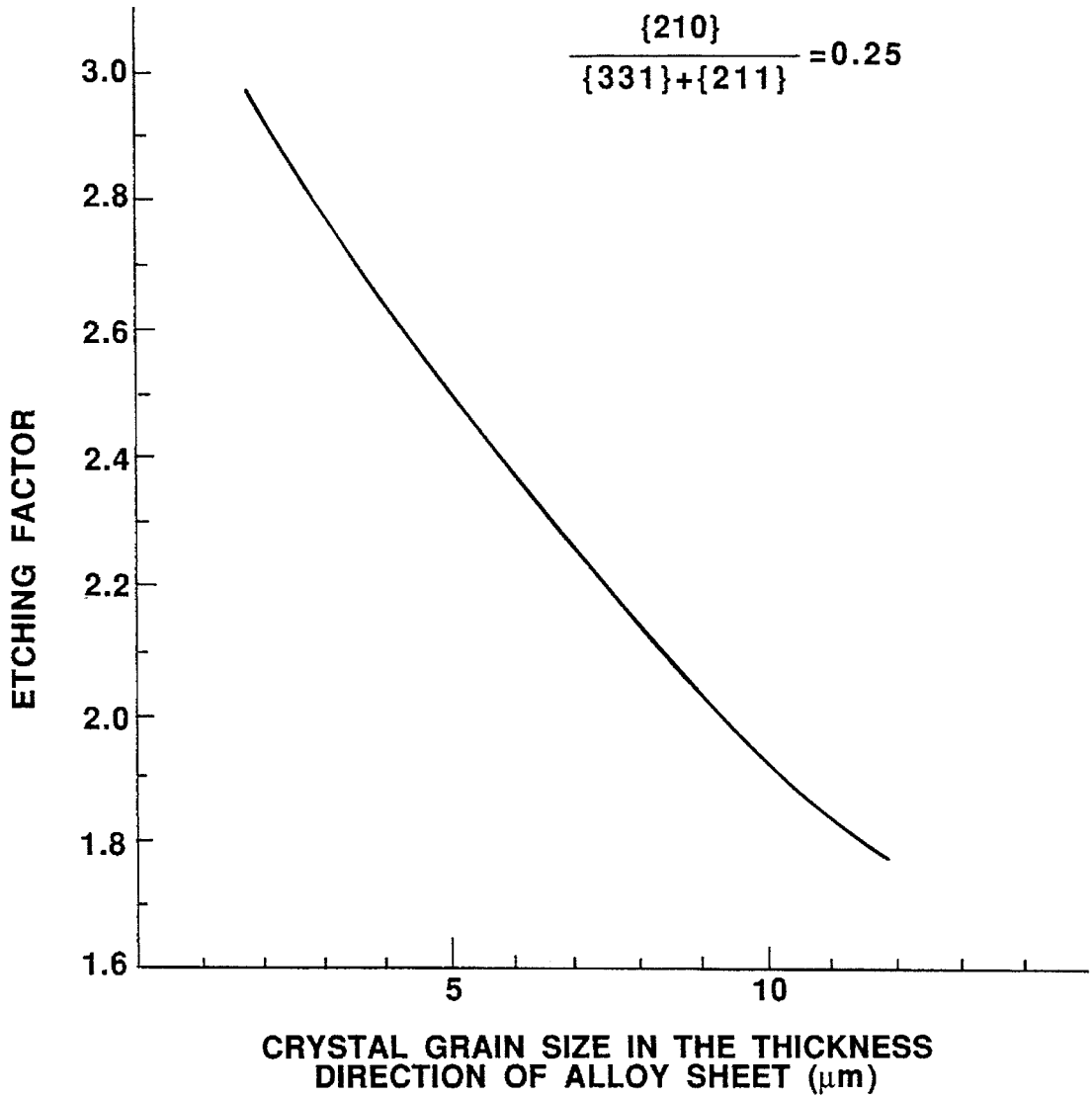
FIG. 4 is a graph showing a relation between the average crystal grain size in the thickness direction of the alloy sheet and the etching factor when of the value of {210}/({331}+{211}) is 0.25.

FIG. 4 shows a relation between the average crystal grain size in the thickness direction of an alloy sheet and the etching factor at 0.25 of the value of {210}/({331}+{211}).

To obtain the value of gathering degree of the planes {331}, {210}, and {211} specified by this invention, the conditions for producing alloy sheets need to be controlled not to induce the formation of these planes. For example, in the case that an alloy sheet of this invention is produced from a hot rolled sheet obtained from a rolled slab, or a continuous cast slab, or a cast plate prepared by direct casting of alloy or hot rolled sheet prepared by hot rolling of the cast plate, annealing of the hot-finished product and controlling the annealing temperature appropriately within a range of 910 ° to 990° C. is means to suppress the formation of each plane described above.

To obtain the value of the ratio of gathering degree of each of {331}, {210}, and {211} planes within a specified range of this invention, it is effective to optimize the conditions of cold rolling rate, recrystallization annealing (annealing temperature, time, and heating rate), and the condition of finish cold rolling in a series of process of cold rolling—recrystallization annealing—finish cold rolling, responding to each gathering degree of {331} plane, {210} plane, and {211} plane after the annealing the above described hot finished products.

To obtain the value of gathering degree of crystal planes specified in this invention, it is not preferable to give uniform heat treatment to a slab prepared by slabbing or continuous casting during the alloy sheet production process. For example, when the uniform heat treatment is carried out at a temperature of 1200° C. or more for a period of 10 hrs or more, at least one of the gathering degree of planes {331}, {210}, and {211} is not within the range specified in this invention. Therefore, such a treatment should be avoided.

The gathering degree of each plane specified by this invention is also obtained, by the adoption-of rapid solidification or texture control through control of recrystallization during hot working other than the method described above,

EXAMPLES

Alloy ingots having compositions of A through C, J, and L listed in Table 1 and Table 3 were prepared by ladel refining. These ingots were subjected to slabbing, surface scarfing, hot rolling (1 100° C. for 3 hrs) after dressing the ingots to prepare hot-rolled sheets. The alloys having compositions of D through I and K listed in Tables 1 through 3 were melted, subjected to refining out of furnace and directly cast to form cast sheets. Subsequently, they were hot-rolled at 1350° to 1000° C. at a 30% reduction ratio, and then they were coiled at 750° C. to prepare hot-rolled sheets.

The obtained hot-rolled sheets were annealed at 910° to 990° C. followed by cold rolling, recrystallization annealing, and finish cold rolling to prepare the alloy sheets of No. 1 through No. 31 having the gathering degree of plane and the average crystal grain size in the thickness direction, as listed in Tables 4 and 5. The gathering degree of each {331} plane, {210} plane, and {211} plane was determined by the X ray diffraction method described before.

Figure 5:
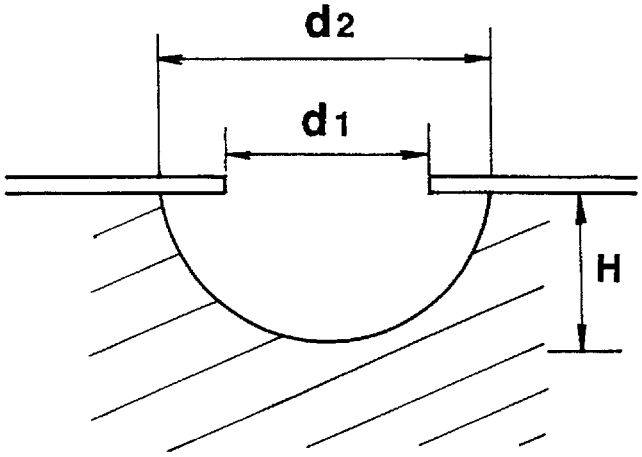
FIG. 5 is an illustrative representation showing the definition of the etching factor and the pierced hole face surface.

On each of the prepared alloy sheets, a resist pattern was placed and the etching factor at 135 μm of d1 shown in FIG. 5 was measured. The method of the etching factor determination is illustrated in FIG. 5. The etching factor was determined by etching the alloy sheet in a bath of ferric chloride solution of 45 Baume's degree at 40° C. under 2.5 kg/cm$^2$ of spray pressure for 50 sec. of spraying. The etching factor is represented by the equation of Ef=2H/(d2–d1).

The alloy sheets of materials No. 1 through No. 24, No. 29 through No. 31 were processed to prepare flat masks by photoetching, and the quantity of the light penetrated through them was measured. The measured quantity of the light penetrated was divided by a quantity of light penetrated through a flat mask having the same size with the prepared flat masks and being made of low carbon steel. The calculated value is treated to be the penetration ratio of light of the flat mask. The surface roughness of pierced hole surface of each of the flat mask prepared was measured by a non-contact type laser roughness gauge. The cut-off value was 0.02 mm, and the tapered area on the pierced hole surface was removed as a waving component to draw a roughness curve, and the centerline average roughness (Ra) was determined from the roughness curve. The production of a blurred periphery of a pierced hole of each of the flat masks was determined by visual observation based on the same creteria used in FIG. 2.

For the alloy sheets of materials No. 25 through No. 28, the surface roughness of the pierced hole surface after photo-etching was determined by the same procedure as described above. Those material samples were processed by soldering, and their solder plating performance was evaluated, also.

As seen in Tables 3 and 4, the materials No. 6 through No. 27 and No. 29 through No. 31 having the value of gathering degree of {331} plane, {210} plane, and {211} plane and the value of {210}/({331}-{211}) within the specified range of this invention showed that the surface roughness, Ra, on the pierced hole surface was at 0.90 μm or less, and that the penetration ratio of light of the flat mask as the shadow mask material was 1.0 or more. Thus, the brightness higher than that of a prior art flat mask of low carbon steel was obtained. These materials also gave excellent solder plating performance as the material for IC lead frames. The etching factor of these materials was 1.8 or more. The flat masks made from the materials No. 6 through No. 24 raised practically no problem in terms of the production of a blurred periphery of a pierced surface hole.

The alloy sheets of the materials No. 6 No.9 through No. 14 showed the value of {210}/({331}+{211}) within a range of 0.25 to 0.26. However, the alloy sheets of No. 9 through No. 14 had 10 μm or less of average crystal grain size in the thickness direction so that they showed a higher etching factor than No. 6 having 11.1 μm of an average crystal grain size, which indicates that these materials are excellent in etching performance. Among the alloy sheets of the materials of No. 9 through No. 14, the ones having a smaller average crystal grain size in the thickness direction gave a higher etching factor. Consequently, the reduction of average crystal grain size in the thickness direction is effective to increase the etching factor.

Contrary to the above examples of this invention, the material No. 1 is an Comparative Example where the gathering degree of {331} plane exceeded the upper limit of this invention. The material No. 2 is a Comparative Example where the gathering degree of {210} plane exceeded the upper limit of this invention. The material No. 3 is a Comparative Example where the gathering degree of {211} plane exceeded the upper limit of this invention. Those three Comparative Examples gave surface roughness of 0.90 μm or more, Ra, of pierced hole surface, and gave less than 1.0 of the penetration ratio of a flat mask, which reduced the brightness of mask compared with the Examples of this invention. The material No. 4 is a Comparative Example where the ratio of degrees of plane of {210}/({331}+{211}) exceeded the upper limit of this invention, and was inferior to the Examples of this invention in terms of the production of a blurred periphery of a pierced hole. The material No. 5 is a Comparative Example where the value of {210}/({331}+{211}) is less than the lower limit of this invention, and gave the etching factor of less than 1.80, which failed to provide the etching performance aimed by this invention. The material No. 28 is a Comparative Example where the gathering degree of both {210} plane and {211} plane exceeded the upper limit of this invention, and the surface roughness, Ra, of pierced hole surface became higher than 0.90 μm, which degraded the solder plating performance after etching.

As clearly indicated by the description given above, the limitation of the gathering degree of each {331} plane, {210} plane, and {211} plane on the surface of an alloy sheet to the range specified by the present invention allows the optimization of the surface roughness, Ra, on the pierced hole surface, which then improves the penetration ratio of light of a flat mask and solder plating performance to an excellent level. Furthermore, the limitation of the ratio of gathering degree of each plane, {210}/({331}+{211}), to the limit specified by the present invention effectively increases the etching factor and reduces the production of a blurred periphery of a pierced hole. In addition, the reduction of average crystal grain size in the thickness direction of the alloy sheet allows to further enhance the etching factor.

TABLE 1

| Chemical composition (wt. % except for H) | | | | | | | | | | | |
|---|---|---|---|---|---|---|---|---|---|---|---|
| Alloy symbol | Ni | H (ppm) | Mn | Al | Si | Cr | Ti | O | N | B | P |
| A | 35.9 | 0.8 | 0.34 | 0.020 | 0.01 | 0.04 | 0.01 | 0.0013 | 0.0011 | 0.00005 | 0.002 |
| B | 35.7 | 0.4 | 0.25 | 0.005 | 0.002 | 0.01 | <0.01 | 0.0009 | 0.0007 | 0.0001 | 0.001 |
| C | 36.4 | 1.0 | 0.05 | 0.010 | 0.05 | 0.02 | 0.02 | 0.0025 | 0.0015 | 0.0001 | 0.004 |
| D | 36.0 | 0.6 | 0.22 | 0.008 | 0.02 | 0.02 | <0.01 | 0.0011 | 0.0011 | 0.0001 | 0.003 |
| E | 32.2 | 0.9 | 0.13 | 0.007 | 0.01 | 0.02 | 0.02 | 0.0022 | 0.0013 | 0.0001 | 0.004 |

| Alloy symbol | S | Mo | W | Nb | V | Cu | C | Co |
|---|---|---|---|---|---|---|---|---|
| A | 0.0010 | 0.03 | 0.02 | 0.02 | 0.02 | 0.02 | 0.0025 | — |
| B | 0.0003 | <0.01 | <0.01 | <0.01 | <0.01 | <0.01 | 0.0014 | 0.002 |
| C | 0.0018 | 0.02 | 0.01 | 0.01 | 0.01 | 0.01 | 0.0047 | 0.03 |
| D | 0.0011 | 0.03 | 0.02 | <0.01 | <0.01 | 0.01 | 0.0031 | 0.700 |
| E | 0.0018 | 0.03 | 0.02 | <0.01 | <0.01 | <0.01 | 0.0015 | 4.100 |

TABLE 2

| Chemical composition (wt. % except for H) | | | | | | | | | | | |
|---|---|---|---|---|---|---|---|---|---|---|---|
| Alloy symbol | Ni | H (ppm) | Mn | Al | Si | Cr | Ti | O | N | B | P |
| F | 31.9 | 0.4 | 0.13 | 0.008 | 0.05 | 0.02 | <0.01 | 0.0021 | 0.0015 | 0.0001 | 0.004 |
| G | 29.5 | 0.8 | 0.35 | 0.010 | 0.01 | 0.03 | <0.01 | 0.0016 | 0.0008 | 0.0020 | 0.003 |
| H | 41.5 | 1.0 | 0.35 | 0.001 | 0.07 | 0.02 | <0.01 | 0.0030 | 0.0011 | 0.0001 | 0.002 |
| I | 28.5 | 1.0 | 0.30 | 0.015 | 0.03 | 0.01 | <0.01 | 0.0030 | 0.0020 | 0.0001 | 0.001 |

TABLE 2-continued

| Chemical composition (wt. % except for H) | | | | | | | | |
|---|---|---|---|---|---|---|---|---|
| Alloy symbol | S | Mo | W | Nb | V | Cu | C | Co |
| F | 0.0013 | 0.03 | 0.02 | <0.01 | <0.01 | 0.02 | 0.0018 | 5.500 |
| G | 0.0005 | 0.01 | 0.01 | <0.01 | <0.01 | 0.01 | 0.0045 | 6.521 |
| H | 0.0010 | 0.01 | 0.01 | <0.01 | <0.01 | 0.02 | 0.0040 | 0.250 |
| I | 0.0015 | 0.01 | 0.01 | <0.01 | <0.01 | 0.01 | 0.0035 | 16.530 |

TABLE 3

| Chemical composition (wt. % except for H) | | | | | | | | | | | |
|---|---|---|---|---|---|---|---|---|---|---|---|
| Alloy symbol | Ni | H (ppm) | Mn | Al | Si | Cr | Ti | O | N | B | P |
| J | 36.5 | 1.9 | 0.37 | 0.005 | 0.01 | 0.95 | <0.01 | 0.0025 | 0.0014 | 0.0015 | 0.001 |
| K | 35.0 | 2.0 | 0.25 | 0.010 | 0.10 | 1.50 | <0.01 | 0.0020 | 0.0018 | 0.0001 | 0.002 |
| L | 35.5 | 1.8 | 0.01 | 0.020 | 0.05 | 2.82 | <0.01 | 0.0010 | 0.0006 | 0.0001 | 0.007 |

| Alloy symbol | S | Mo | W | Nb | V | Cu | C | Co |
|---|---|---|---|---|---|---|---|---|
| J | 0.0010 | 0.02 | 0.01 | <0.01 | <0.01 | 0.01 | 0.0030 | — |
| K | 0.0006 | 0.02 | 0.02 | <0.01 | <0.01 | 0.01 | 0.0020 | 0.502 |
| L | 0.0008 | 0.01 | 0.01 | <0.01 | <0.01 | 0.01 | 0.0006 | 0.520 |

TABLE 4

| Alloy symbol | Material No. | Gathering degree of plane (%) [331] | [210] | [211] | [210]/([331] + [211]) | Average crystal grain size in the thickness direction of sheet (μm) | Surface roughness, Ra, of pierced hole surface (μm) | Penetration ratio of light of a flat mask | Production of blurred periphery of pierced hole | Etching factor | Solder plating performance |
|---|---|---|---|---|---|---|---|---|---|---|---|
| C | 1 | 18 | 10 | 7 | 0.40 | 13.2 | 1.08 | 0.95 | B | 1.81 | — |
| B | 2 | 13 | 16 | 5 | 0.89 | 11.2 | 0.93 | 0.98 | B | 2.01 | — |
| B | 3 | 12 | 7 | 15 | 0.26 | 8.8 | 1.16 | 0.91 | A | 2.09 | — |
| A | 4 | 2 | 7 | 4 | 1.17 | 11.1 | 0.87 | 1.01 | E | 2.24 | — |
| A | 5 | 14 | 3 | 9 | 0.13 | 11.1 | 0.79 | 1.04 | B | 1.76 | — |
| B | 6 | 13 | 4 | 3 | 0.25 | 11.1 | 0.76 | 1.05 | A | 1.82 | — |
| B | 7 | 7 | 6 | 4 | 0.55 | 11.1 | 0.61 | 1.09 | A | 1.96 | — |
| B | 8 | 1 | 5 | 4 | 1.00 | 11.1 | 0.67 | 1.08 | C | 2.17 | — |
| C | 9 | 8 | 3 | 4 | 0.25 | 10.0 | 0.72 | 1.06 | A | 1.92 | — |
| C | 10 | 12 | 5 | 7 | 0.26 | 8.3 | 0.53 | 1.13 | A | 2.11 | — |
| C | 11 | 8 | 4 | 6 | 0.25 | 6.9 | 0.40 | 1.17 | A | 2.25 | — |
| C | 12 | 3 | 2 | 5 | 0.25 | 5.3 | 0.39 | 1.16 | A | 2.48 | — |
| C | 13 | 8 | 3 | 4 | 0.25 | 3.5 | 0.30 | 1.20 | A | 2.69 | — |
| C | 14 | 2 | 1 | 2 | 0.25 | 2.0 | 0.21 | 1.22 | A | 2.92 | — |

TABLE 5

| Alloy symbol | Material No. | Gathering degree of plane (%) [331] | [210] | [211] | [210]/([331] + [211]) | Average crystal grain size in the thickness direction of sheet (μm) | Surface roughness, Ra, of pierced hole surface (μm) | Penetration ratio of light of a flat mask | Production of blurred periphery of pierced hole | Etching factor | Solder plating performance |
|---|---|---|---|---|---|---|---|---|---|---|---|
| B | 15 | 9 | 10 | 9 | 0.56 | 8.8 | 0.56 | 1.10 | A | 2.23 | — |
| A | 16 | 11 | 10 | 9 | 0.50 | 8.9 | 0.56 | 1.11 | A | 2.20 | — |
| A | 17 | 3 | 2 | 1 | 0.50 | 7.7 | 0.54 | 1.12 | A | 2.30 | — |
| A | 18 | 0 | 2 | 3 | 0.67 | 3.3 | 0.35 | 1.18 | B | 2.91 | — |
| B | 19 | 1 | 1 | 1 | 0.50 | 5.5 | 0.46 | 1.14 | 1 | 2.63 | — |
| A | 20 | 1 | 1 | 1 | 0.50 | 7.7 | 0.52 | 1.12 | A | 2.31 | — |
| C | 21 | 5 | 5 | 4 | 0.56 | 7.0 | 0.43 | 1.15 | A | 2.40 | — |
| D | 22 | 6 | 5 | 5 | 0.45 | 8.1 | 0.72 | 1.04 | A | 2.23 | — |
| E | 34 | 6 | 3 | 4 | 0.30 | 8.0 | 0.70 | 1.06 | A | 2.20 | — |
| F | 24 | 5 | 4 | 4 | 0.44 | 8.2 | 0.71 | 1.05 | A | 2.22 | — |
| H | 25 | 5 | 5 | 5 | 0.50 | 10.0 | 0.75 | — | — | 2.10 | Good |

TABLE 5-continued

| Alloy symbol | Material No. | Gathering degree of plane (%) [331] | [210] | [211] | [210]/([331] + [211]) | Average crystal grain size in the thickness direction of sheet (μm) | Surface roughness, Ra, of pierced hole surface (μm) | Penetration ratio of light of a flat mask | Production of blurred periphery of pierced hole | Etching factor | Solder plating performance |
|---|---|---|---|---|---|---|---|---|---|---|---|
| G | 26 | 6 | 6 | 5 | 0.55 | 9.5 | 0.70 | — | — | 2.13 | Good |
| H | 27 | 11 | 10 | 9 | 0.50 | 9.3 | 0.73 | — | — | 2.15 | Good |
| I | 28 | 8 | 16 | 15 | 0.70 | 9.5 | 1.20 | — | — | 1.80 | Bad |
| J | 29 | 11 | 10 | 10 | 0.48 | 9.0 | 0.55 | 1.11 | A | 2.22 | — |
| K | 30 | 10 | 9 | 9 | 0.47 | 9.1 | 0.56 | 1.11 | A | 2.21 | — |
| L | 31 | 10 | 10 | 10 | 0.50 | 8.9 | 0.54 | 1.12 | A | 2.23 | — |

Preferred Embodiment-2

The present invention provides sheets of Fe—Ni, Fe—Ni—Co, Fe—Ni—Cr, or Fe—Ni—Co—Cr alloy with a uniform fine pattern by a photo-etching process on the whole surface area thereof. To do this, it is important to maintain the etching speed at a high rate all over surface and to increase the etching factor. In concrete terms, the control of the ratio of gathering degree of specific planes on the etched surface (alloy surface) and the control of the crystal grain size in the thickness direction of the alloy sheet are required.

In addition, for further improvement of the brightness of the light penetrated through a flat mask having been pierced by etching, it is important to reduce the surface roughness, Ra (centerline average roughness), of the alloy sheet being etched at or below the specified value. The reduction of the surface roughness, Ra, to a specific value or finer level is performed by controlling the gathering degree of specific planes near the surface of the alloy sheet being etched. This invention focuses on these means described above. The reasons for giving a numerical limitation on these means will now be explained.

The reason to limit the content of components by percent the specified is described below. When an alloy sheet of Fe—Ni of this invention for electronic devices is employed as the material for a shadow mask, the color phase shift which may be induced by expansion of the material shall be prevented. Accordingly, the average thermal expansion coefficient of the alloy within a temperature range of 30 to 100° C. is necessary to be limit to $2.0\times10^{-6}$/°C. or below. The Ni content to satisfy the condition of average thermal expansion coefficient is in a range of 34 to 38 wt. % for Fe—Ni alloy sheet. When the Fe—Ni alloy sheets for electronic devices are used as the IC lead frame material, the Ni content necessary to balance the thermal expansion of semiconductor, glass, and ceramics is above 38 wt. %, but 52 wt. %, or less. Consequently, the Ni content is specified to a range of 34 to 52 wt. % considering the two points above described.

In a Fe—Ni—Co alloy sheet, when the Co content is 20 wt. % or less, the Ni content to satisfy the condition of the average thermal expansion coefficient is in a range of 28 to 38 wt. %. When the Co content exceeds 20 wt. %, there is no Ni content that satisfies the condition of thermal expansion coefficient. Therefore, the Ni content for Fe—Ni—Co alloy sheets is specified to a range of 28 to 38 wt. % and the Co content for the material is specified at 20 wt. % or less.

Chromium is an element which improves the mechanical properties of alloy. However, the addition of Cr tends to increase the average thermal expansion coefficient. Accordingly, to attain the average thermal expansion coefficient described above, the Cr content shall be 3 wt. % or less. Consequently, for Fe—Ni—Cr alloy sheets, the Ni content is limited to a range of 34 to 52 wt. % and the Cr content to 3 wt. % or less, and for Fe—Ni—Co alloy sheets, the Ni content is limited to a range of 28 to 38 wt. %, the Co content to 20 wt. % or less, and the Cr content to 3 wt. % or less.

The following is the reason to limit the gathering degree of each crystal plane. The X ray diffraction analysis on the surface of alloy sheet gives an X ray diffraction intensity of each diffraction plane of {111}, {200}, {220}, {311}, {420} and {422}. The gathering degree of each plane orientation is determined from the X ray diffraction intensity. For example, the gathering degree of {111} plane is determined from the relative X ray diffraction intensity ratio of (111) plane divided by the sum of the relative X ray diffraction intensity ratio of each diffraction plane, (111), (200), {220}, {311}, {331}, {420} and {422}.

The gathering degree of each plane, {100}, {110}, {311}, {331}, {210}, and {211}}is determined by the same procedure. The relative X ray diffraction intensity ratio is defined by the X ray diffraction intensity determined on each diffraction plane divided by the theoretical X ray diffraction intensity on the corresponding diffraction plane. For instance, the relative X ray diffraction intensity ratio of the {111} plane is determined from the X ray diffraction intensity of the {111} plane divided by the theoretical X ray diffraction intensity of the {111} diffraction plane. The gathering degree of {100} is determined from the relative X ray diffraction instensity ratio of the plane {200} having the same orientation with each of the former planes, divided by the sum of the relative X ray diffraction intensity ratio of the seven diffraction planes, {111} through (422), described above. The gathering degree of each of planes {110}, {210} and {211} is also determined from the relative X ray diffraction intensity ratio of each of the plane {220}, {420} and {422}.

From the study of the gathering degree of each plane, which was derived from the above procedure, the inventors found that the control of the gathering degree of the planes {111}, {100}, {110}, and {311} on the surface of alloy sheets of an Fe—Ni, an Fe—Ni—Co, an Fe—Ni—Cr, or an Fe—Ni—Co—Cr alloy suppresses the curving of the sheets after etching and prevents the production of blurred periphery of pierced hole.

When the gathering degree of the {100} plane increases to 50% or more, the curving after etching is suppressed. When, however, the gathering degree of the {100} plane exceeds 94%, production of an blurred periphery of a pierced hole occurs. Consequently, the gathering degree of the {100} plane is specified to a range of 50 to 94%.

On the other hand, the gathering degree of the planes {111}, {110}, and {311} tends to increase the occurrence of curving after etching. When the gathering degree of {111} plane exceeds 10%, that of {110} plane exceeds 24%, and that of {311} plane exceeds 14%, the occurrence of curving after etching becomes significant, which degrades the quality of flat mask.

When the gathering degree of the planes {111}, {110}, and {311} is below 1%, the etching factor considerably reduces. Consequently, the gathering degree of {111} plane is specified to a range of 1 to 10%, that of {110} plane is specified to a range of 1 to 24%, and that of {311} plane is specified to a range of 1 to 14%.

The inventors further found that the control of the gathering degree of each plane, {331}, {210}, and {211}, and the control of the ratio of the gathering degree of each plane, {111}, {100}, {110}, and {311} on the surface of alloy sheets of Fe—Ni, Fe—Ni—Co, Fe—Ni—Cr, and Fe—Ni—Co—Cr alloys increase the etching factor and decrease the surface roughness (Ra, centerline average roughness) on the pierced hole face, and increase the brightness of the light penetrated through a flatmask.

Figure 6:
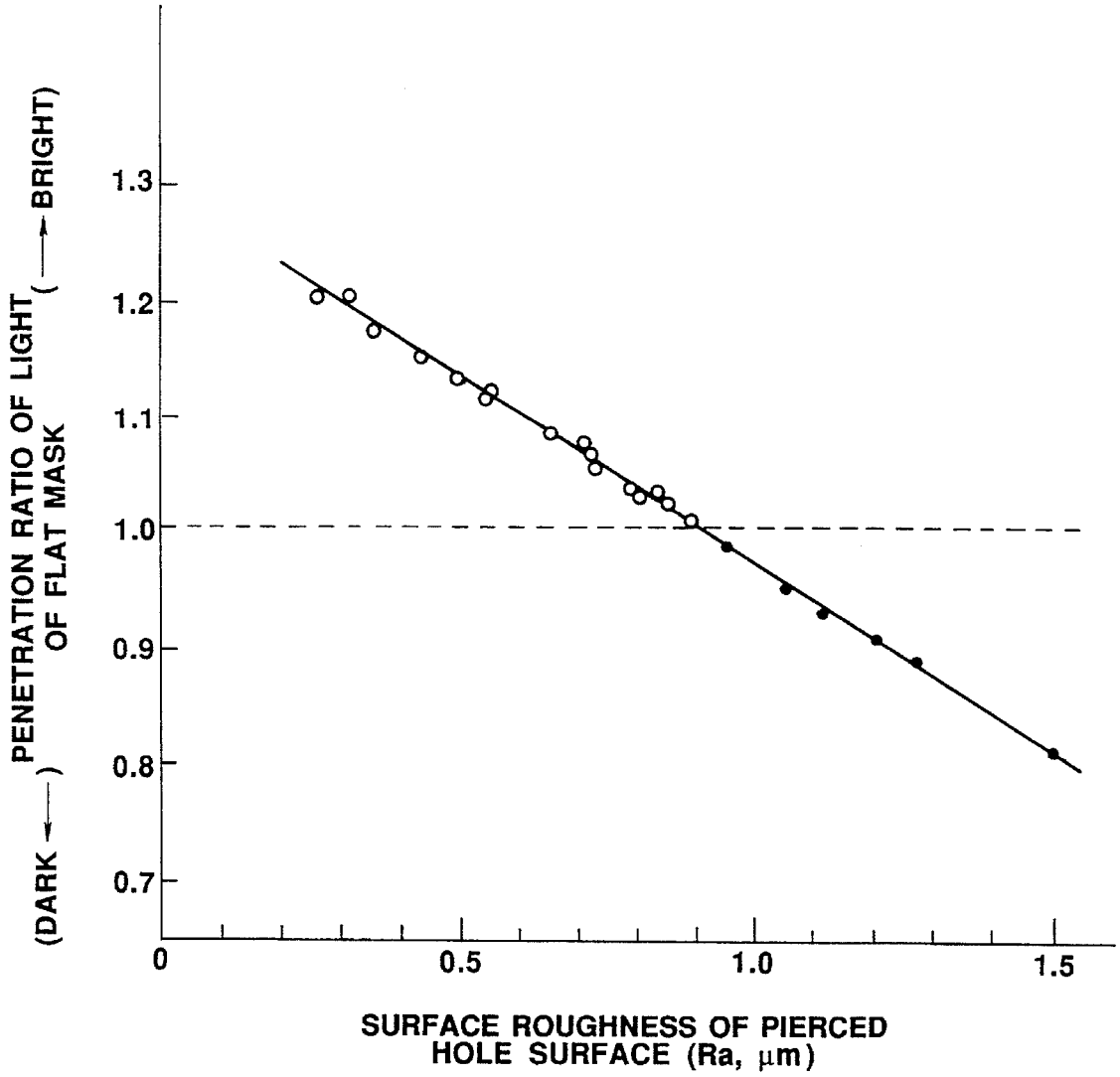
FIG. 6 is a graph showing relation between the light penetration through a flat mask and the surface roughness on pierced hole surface according to the Preferred Embodiment-2.

FIG. 6 shows the plot of the calculated penetration ratio of light vs. surface roughness (Ra) on pierced hole. In FIG. 6, white circles (○) correspond to the following conditions:

degree of {111} plane: 1 to 14%, degree of {100} plane: 50 to 94%, degree of {110} plane: 1 to 24%, degree of {311} plane: 1 to 14%, degree of {331} plane: 1 to 14%, degree of {210} plane: 1 to 14%, degree of {211} plane: 1 to 14%, The black circles (●) correspond to the following conditions:

degree of{331} plane: 1 to 14%, degree of {210} plane: 1 to 14%, degree of {211} plane: 1 to 14%, Even though the gathering degree of the planes {111}, {100}, {110}, and {311} is controlled within a range specified above, if each of the gathering degrees of the planes {331}, {210}, and {211} exceeds 14%, then the surface roughness of pierced hole face becomes rough. The relation is indicated by the black dots (●) in FIG. 6 which shows the relation between the penetration ratio of light through flat mask and the surface roughness, (Ra, μm), on pierced hole face. As seen in the figure, the surface roughness on pierced hole surface becomes rough, the penetration ratio of light through a flat mask becomes low, or the penetration ratio of light through the flat mask becomes dark.

On the contrary, when each of the gathering degrees of the planes {331}, {210}, and {211} is controlled at or below 14%, the surface roughness on pierced hole surface becomes rough and the penetration ratio of light through a flat mask becomes high, or the penetration ratio of light through the flat mask becomes bright, which relation is shown by the white dots (○) in FIG. 6. The penetration ratio of light of a flat mask is defined by a value obtained by dividing a quantity of light penetrated through a flat mask made of the alloy sheet material with a quantity of light penetrated through a flat mask having the same pierced hole with that of the former and being made of conventional low carbon steel. When the penetration ratio of light is 1 or higher, the flat mask of the present invention gives higher brightness than that of the conventional mask.

Accordingly, each of the gathering degrees of the planes {331}, {210}, and {211} is needed to maintain at 14% or less. However, when these values become less than 1%, the etching factor decreases. Therefore, the gathering degree of {331} plane is specified to be in a range of 1 to 14%, that of {210} plane is specified to be in a range of 1 to 14%, and that of {211} plane is specified to be in a range of 1 to 14%.

Figure 7:
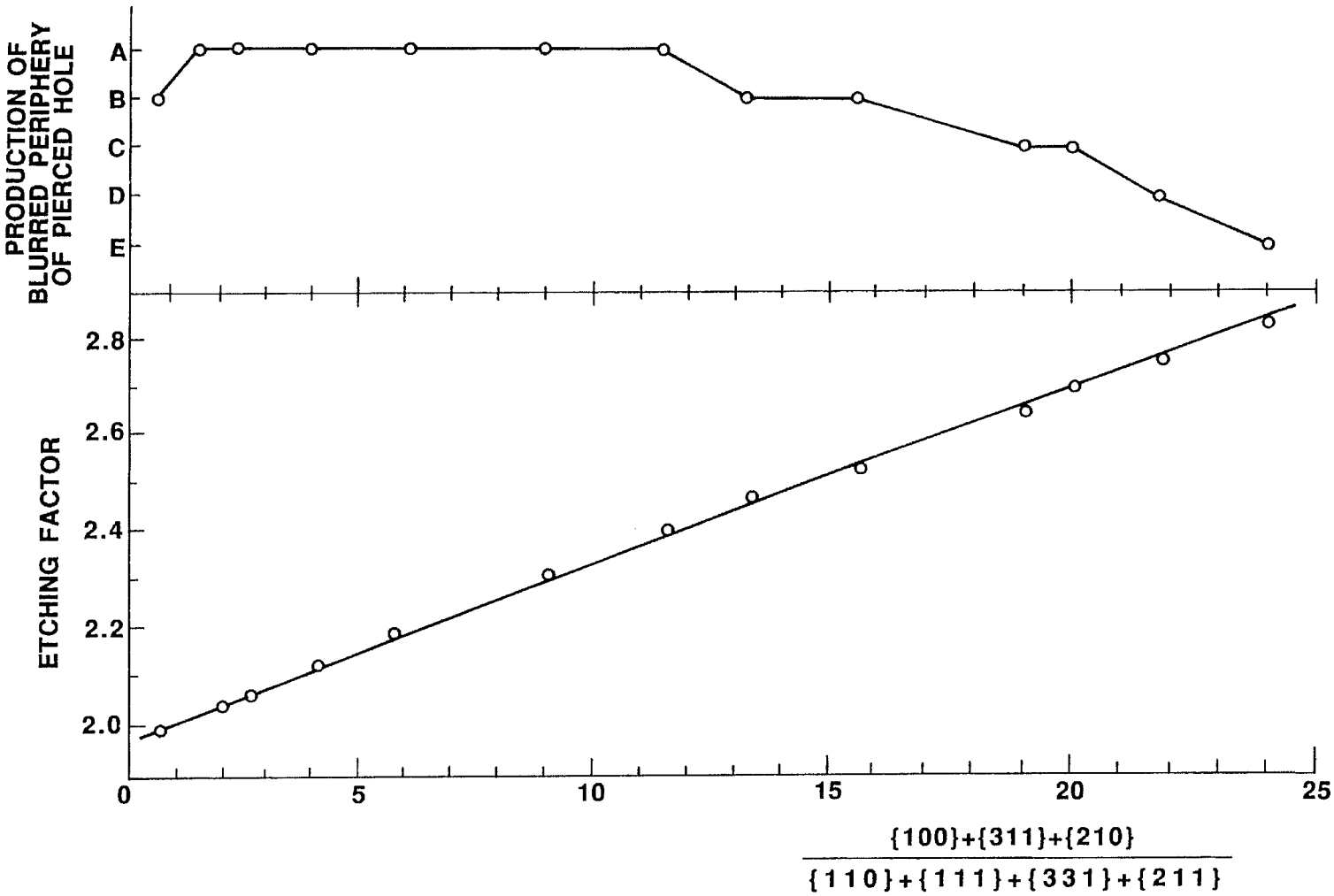
FIG. 7 is a graph showing a relation among a ratio of the degree of planes ({100}+{311}+{210})/({100}+{111}+{331}+{211}), the etching factor, and the production of a blurred periphery of a pierced surface according to the Preferred Embodiment-2.

Control of the gathering degree of the main 7 planes on the surface of alloy sheet is important for the improvement of etching factor. FIG. 7 is a graph showing the relation among the etching factor, the production of a blurred periphery of a pierced hole, and the value of $(S_2+S_4+S_6)/(St+S_3+S_5+S_7)$, which value is the sum of the gathering degree $S_2$ of {100} plane, the gathering degree $S_4$ of {311} plane, and the gathering degree $S_6$ of {210} plane, divided by the sum of the gathering degree $S_1$ of {111} plane, the gathering degree $S_3$ of {110} plane, the gathering degree $S_5$ of {331} plane, and the gathering degree $S_7$ of {211} plane. The figure covers the range 1 to 10% for {111} plane, 50 to 94% for {100} plane, 1 to 24% for {110} plane, 1 to 14% for {311} plane, 1 to 14% for {331} plane, 1 to 14% for {210} plane, and 1 to 14% for {211} plane. The degree of production of a blurred periphery of a pierced hole was determined by visual observation to classify into: "A" for "no production of a blurred periphery of a pierced hole"; "E" for "severe production of a blurred periphery of a pierced hole, and raising problems on practical application", "B" through "D" were ranked between "A" and "E". The ranks of "A" through "C" were defined as "no problem on practical application".

As seen in FIG. 7, the value of etching factor increases with the increase of the value of $(S_2+S_4+S_6)/(S_1+S_3+S_5+S_7)$, and the degree of production of a blurred periphery of a pierced hole tends to become worse when the value of $(S_2+S_4+S_6)/(S_1+S_3+S_5+S_7)$ extremely decreased or increased. Accordingly, the value of $(S_2+S_4+S_6)/(S_1+S_3+S_5+S_7)$ is specified to be a range of 0.8 to 20, which range raises no practical problem. The value ranges more preferably 1.5 to 11.5 since the production of a blurred periphery of a pierced hole does not appear in the range.

Figure 8:
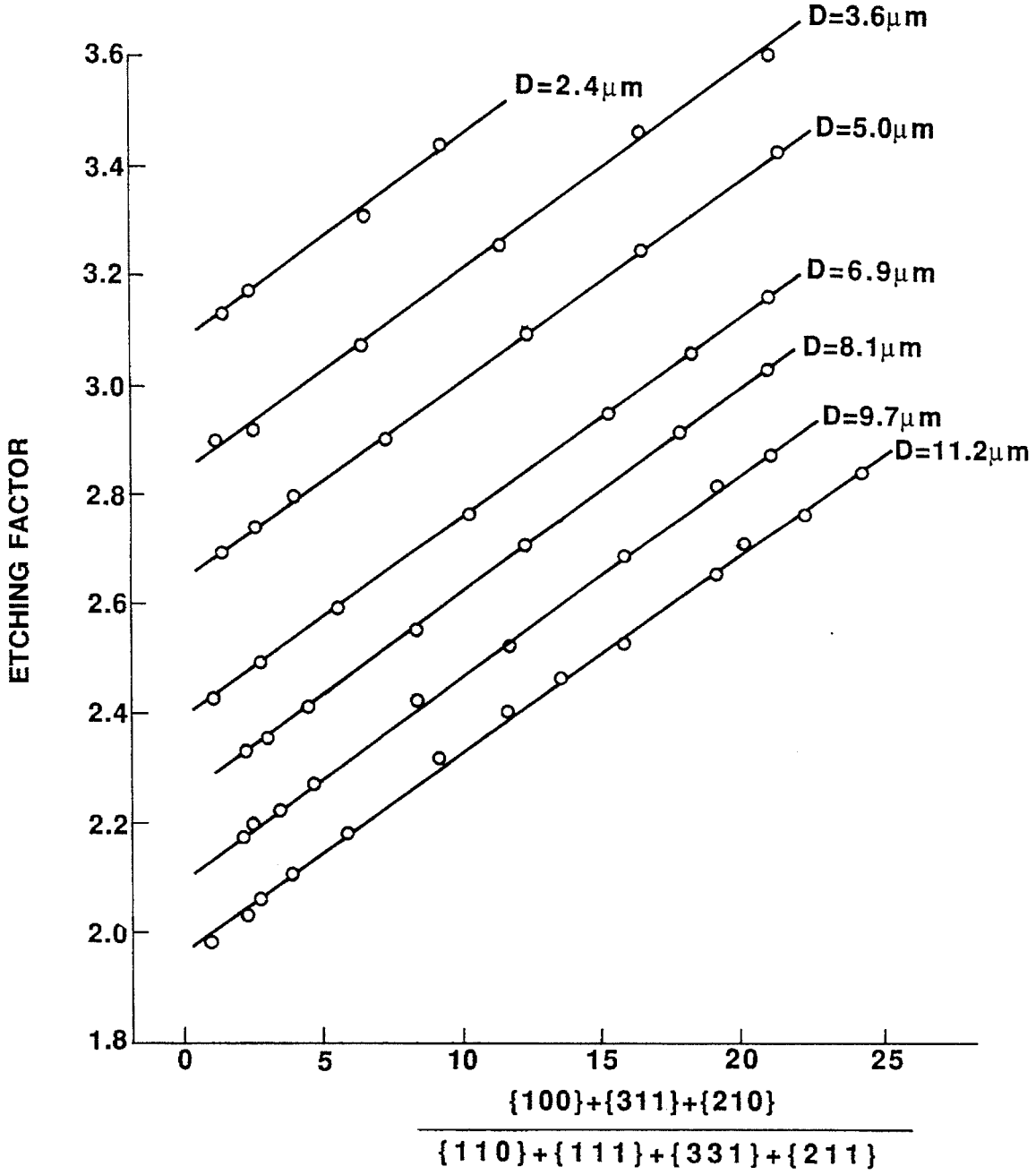
FIG. 8 is a graph showing a relation between a ratio of the degree of planes ({100}+{311}+{210})/({100}+{111}+{331}+{211}) and the etching factor using a crystal grain size in a thickness direction of the alloy sheet: as a parameter according to the Preferred Embodiment-2.
Figure 9:
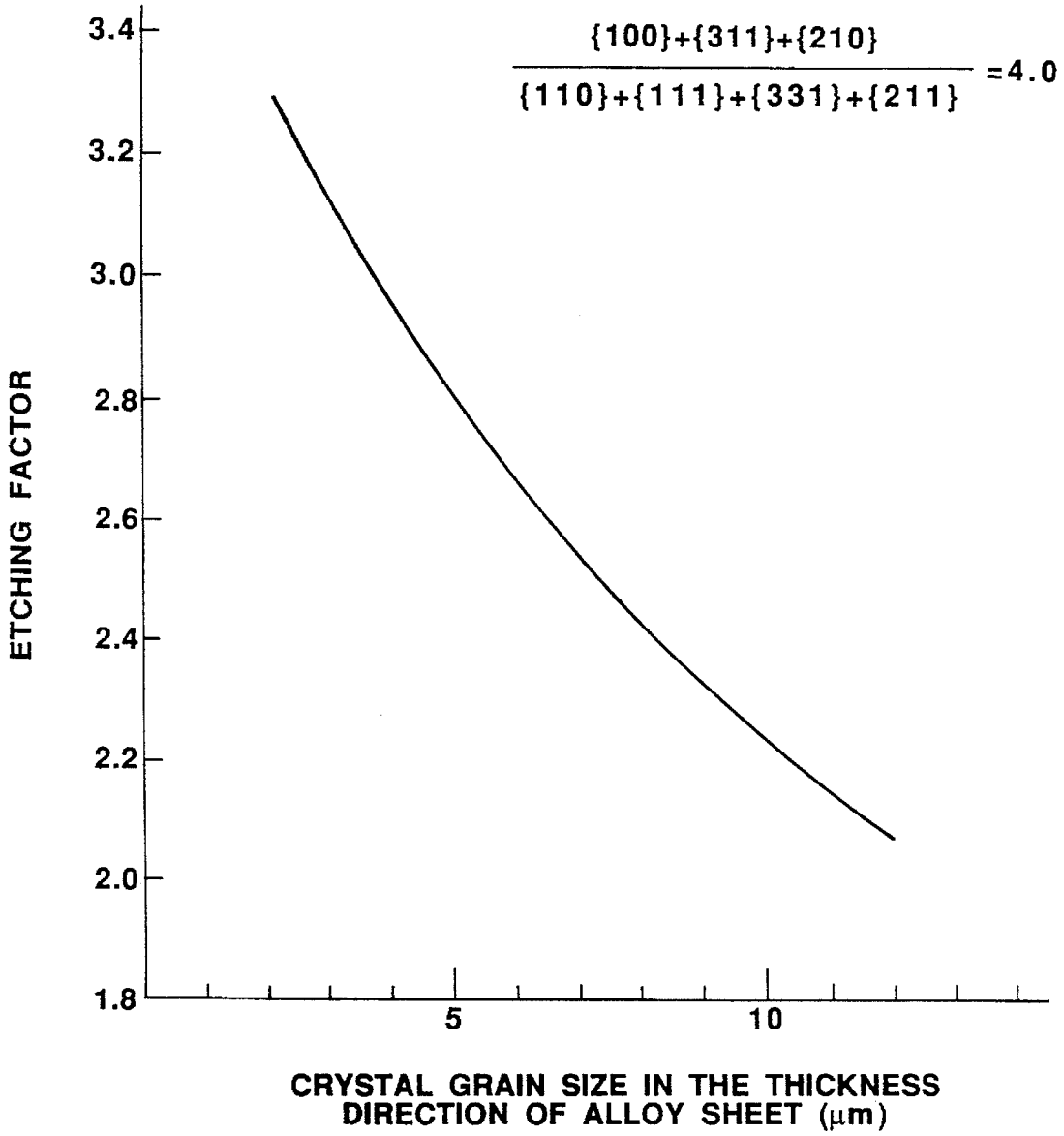
FIG. 9 is a graph showing a relation between the grain size in the thickness direction of the alloy sheet and the etching factor according to the Preferred Embodiment-2.

FIG. 8 is a graph showing the relation between the value of $(S_2+S_4+S_6)/(S_1+S_3+S_5+S_7)$ and the etching factor using the grain size (D) in the thickness direction of the sheet as the parameter. The figure covers the range 1 to 10% for {111} plane, 50 to 94% for {100} plane, 1 to 24% for {110} plane, 1 to 14% for {311} plane, 1 to 14% for {331} plane, 1 to 14% for {210} plane, and 1 to 14% for {211 } plane. FIG. 9 is the graph showing the relation between the grain size in the thickness direction of sheet and the etching factor.

As shown in FIG. 8 and FIG. 9, the increase of crystal grain size in the thickness direction of the sheet reduces the etching factor. Accordingly, the crystal grain size in the thickness direction of the sheet is specified as 10 μm or less to secure an etching factor of 2 or more which raises no practical problem. If the crystal grain size is 6 μm or less, the etching factor is still further increased.

The present invention provides an alloy sheet for electronic devices having excellent etching performance, which specifies the main component of an Fe—Ni, an Fe—Ni—Co, an Fe—Ni—Cr, or an Fe—Ni—Co—Cr alloy, the gathering degree of the planes on the surface of the alloy sheet and its ratio, and the crystal grain size on the surface of the alloy sheet in the thickness direction. Adding to those main components, these alloy sheets of this invention preferably have the components of 0.05 wt. % or less C, 0.60 wt. % or less Mn, 0.30 wt. % or less Si, 0.0030 wt. % or less N, and 0.0060 wt. % or less O.

Cobalt, an impurity, does not affect the etching performance if the content is 1 wt. % or less.

To keep the gathering degree of the planes on the surface of alloy sheets within the range specified by this invention, it is preferred to select adequate producing conditions of avoiding the formation of those planes during the processing stage to produce alloy sheets from molten steel, which stage includes solidification of molten steel, hot rolling, cold rolling, and annealing. For example, when the alloy sheet of the present invention is prepared from a hot-rolled steel sheet which was obtained by slabbing and a steel ingot or a continuous cast and hot rolling the slabbed slab, the annealing the hot-rolled Steel sheet after the hot rolling is satisfactory. Temperature of the annealing is preferably selected in a range of 910° to 990° C., dependent on the reduction ratio of hot-rolling.

The characteristics of the alloy sheets of this invention are realized by optimizing the conditions of reduction ratio of cold rolling and annealing (temperature, time and heating rate) responding to individual values of gathering degree of each plane on the surface of alloy sheet after the annealing of the hot rolled sheet. The annealing is effective when the hot-rolled alloy sheet is sufficiently crystallized before the annealing of hot-rolled sheet.

To acquire the satisfactory gathering degree of these seven planes being focused on in the present invention, a uniform treatment of the slab after slabbing is not perferable. For example, when the uniform treatment is carried out at 1200° C. or higher temperature for 10 hours or longer period, at least one of the gathering degrees of these seven planes exceeds the range specified in the present invention. Therefore, such a uniform treatment must be avoided.

EXAMPLE

This invention is described in more detail referring to examples. The molten steel was refined with ladle and cast to produce alloy ingots having the composition of A through N listed in Tables 6.

Those ingots were subjected to slabbing to prepare slabs after the surface scarfing of the ingots was done. The slabs were further treated by surface scarfing, and were heated in a furnace at 1100° C. for 3 hrs followed by hot-rolling to obtain hot-rolled sheets. The ahoy sheet of the alloy No. N was refined at out of furnace followed by direct casting into a slab, and was then treated by hot-rolling at 1350° to 1000° C. at 30% of reduction ratio to form a steel sheet. The obtained hot-rolled steel sheets were annealed at 910° to 990° C. followed by cold rolling and annealing while changing the rolling condition or annealing condition. The obtained alloy sheets were the alloys No. A through N. Tables 7, 8, and 9 list the characteristics of thus obtained materials No. 1 through No. 52, which include the gathering degree, $S_1$ to $S_7$ (%) of the seven planes thereof, the value of $(S_2+S_4+S_6)/(S_1+S_3+S_5+S_7)$, and the crystal grain size (μm ) in the thickness direction of the alloy sheet.

TABLE 6

(Unit: wt. % except for H)

| Alloy symbol | Ni | H(ppm) | Mn | Al | Si | Cr | Ti | O | N | W | Nb |
|---|---|---|---|---|---|---|---|---|---|---|---|
| A | 35.9 | 0.8 | 0.34 | 0.020 | 0.01 | 0.04 | 0.01 | 0.0013 | 0.0011 | 0.02 | 0.02 |
| B | 35.7 | 0.4 | 0.25 | 0.005 | 0.002 | 0.01 | <0.01 | 0.0009 | 0.0007 | <0.01 | <0.01 |
| C | 36.4 | 1.0 | 0.05 | 0.010 | 0.05 | 0.02 | 0.02 | 0.0025 | 0.0015 | 0.01 | 0.01 |
| D | 36.1 | 1.7 | 0.22 | 0.011 | 0.03 | 0.01 | <0.01 | 0.0015 | 0.0009 | <0.01 | <0.01 |
| E | 36.0 | 0.6 | 0.22 | 0.008 | 0.02 | 0.02 | <0.01 | 0.0011 | 0.0011 | 0.02 | <0.01 |
| F | 32.1 | 1.2 | 0.11 | 0.012 | 0.01 | 0.01 | <0.01 | 0.0011 | 0.0011 | <0.01 | <0.01 |
| G | 32.2 | 0.9 | 0.13 | 0.007 | 0.01 | 0.02 | 0.02 | 0.0022 | 0.0013 | 0.02 | <0.01 |
| H | 31.9 | 0.4 | 0.13 | 0.008 | 0.05 | 0.02 | <0.01 | 0.0021 | 0.0015 | 0.02 | <0.01 |
| I | 29.5 | 0.8 | 0.34 | 0.010 | 0.01 | 0.03 | <0.01 | 0.0016 | 0.0008 | 0.01 | <0.01 |
| J | 41.5 | 1.0 | 0.35 | 0.001 | 0.07 | 0.02 | <0.01 | 0.0030 | 0.0020 | 0.01 | <0.01 |
| K | 28.5 | 1.0 | 0.30 | 0.015 | 0.03 | 0.01 | <0.01 | 0.0030 | 0.0020 | 0.01 | <0.01 |
| L | 36.5 | 1.0 | 0.37 | 0.005 | 0.01 | 0.95 | <0.01 | 0.0025 | 0.0014 | 0.01 | <0.01 |
| M | 35.0 | 2.0 | 0.25 | 0.010 | 0.10 | 1.50 | <0.01 | 0.0020 | 0.0018 | 0.02 | <0.01 |
| N | 35.5 | 1.8 | 0.01 | 0.020 | 0.05 | 2.82 | <0.01 | 0.0010 | 0.0006 | 0.01 | <0.01 |

| Alloy symbol | V | Cu | C | B | P | S | Mo | Co |
|---|---|---|---|---|---|---|---|---|
| A | 0.02 | 0.02 | 0.0025 | 0.0005 | 0.002 | 0.0010 | 0.03 | — |
| B | <0.01 | <0.01 | 0.0014 | 0.0001 | 0.001 | 0.0003 | <0.01 | 0.001 |
| C | 0.01 | 0.01 | 0.0047 | 0.0001 | 0.004 | 0.0018 | 0.02 | 0.02 |
| D | <0.01 | <0.01 | 0.0011 | 0.0001 | 0.002 | 0.0005 | <0.01 | 0.002 |
| E | <0.01 | 0.01 | 0.0031 | 0.0001 | 0.003 | 0.0011 | 0.03 | 0.7 |
| F | <0.01 | <0.01 | 0.0012 | 0.0001 | 0.001 | 0.0009 | <0.01 | 5.1 |
| G | <0.01 | <0.01 | 0.0015 | 0.0001 | 0.004 | 0.0018 | 0.03 | 4.1 |
| H | <0.01 | 0.02 | 0.0018 | 0.0001 | 0.004 | 0.0013 | 0.03 | 5.7 |
| I | <0.01 | 0.01 | 0.0045 | 0.0020 | 0.003 | 0.0005 | 0.01 | 6.521 |
| J | <0.01 | 0.02 | 0.0040 | 0.0001 | 0.002 | 0.0010 | 0.01 | 0.250 |
| K | <0.01 | 0.01 | 0.0035 | 0.0001 | 0.001 | 0.0015 | 0.01 | 16.530 |
| L | <0.01 | 0.01 | 0.0030 | 0.0015 | 0.001 | 0.0010 | 0.02 | — |
| M | <0.01 | 0.01 | 0.0020 | 0.0001 | 0.002 | 0.0006 | 0.02 | 0.502 |
| N | <0.01 | 0.01 | 0.0006 | 0.0008 | 0.002 | 0.0008 | 0.01 | 0.520 |

TABLE 7

| Alloy symbol | Material No. | Gathering degree of plane (%) $S_1$ | $S_2$ | $S_3$ | $S_4$ | $S_5$ | $S_6$ | $S_7$ | $\frac{(S_2+S_4+S_6)}{(S_1+S_3+S_5+S_7)}$ | Crystal grain size in the thickness direction of alloy sheet (μm) |
|---|---|---|---|---|---|---|---|---|---|---|
| A | 1 | 11 | 50 | 7 | 6 | 11 | 8 | 7 | 1.78 | 11.0 |
| A | 2 | 1 | 38 | 23 | 10 | 9 | 10 | 9 | 1.38 | 11.5 |
| A | 3 | 1 | 95 | 2 | 0 | 1 | 0 | 1 | 19.00 | 13.4 |
| A | 4 | 1 | 50 | 30 | 8 | 2 | 5 | 4 | 1.70 | 11.1 |
| C | 5 | 1 | 50 | 20 | 16 | 6 | 2 | 5 | 2.13 | 11.2 |
| C | 6 | 2 | 57 | 5 | 4 | 15 | 10 | 7 | 2.45 | 13.2 |
| C | 7 | 4 | 50 | 7 | 1 | 14 | 16 | 8 | 2.03 | 11.1 |
| B | 8 | 2 | 51 | 5 | 5 | 12 | 9 | 16 | 1.86 | 11.1 |
| B | 9 | 0 | 92 | 4 | 1 | 2 | 1 | 0 | 15.67 | 11.5 |
| B | 10 | 1 | 91 | 0 | 1 | 6 | 0 | 1 | 11.50 | 12.2 |
| C | 11 | 0 | 73 | 12 | 10 | 0 | 2 | 3 | 5.67 | 13.2 |
| A | 12 | 1 | 91 | 0 | 0 | 6 | 1 | 1 | 11.50 | 11.0 |
| B | 13 | 1 | 52 | 23 | 4 | 9 | 2 | 9 | 0.72 | 11.2 |
| B | 14 | 1 | 93 | 1 | 1 | 1 | 2 | 1 | 24.0 | 11.2 |
| B | 15 | 2 | 63 | 9 | 4 | 12 | 5 | 5 | 2.57 | 11.2 |
| A | 16 | 2 | 58 | 16 | 6 | 7 | 6 | 5 | 2.23 | 9.7 |
| A | 17 | 1 | 56 | 22 | 7 | 5 | 5 | 4 | 2.13 | 3.6 |
| B | 18 | 1 | 52 | 24 | 9 | 4 | 6 | 4 | 2.03 | 11.2 |
| A | 19 | 3 | 61 | 13 | 6 | 8 | 6 | 3 | 2.70 | 8.1 |
| C | 20 | 2 | 65 | 12 | 6 | 8 | 5 | 2 | 3.17 | 9.7 |

TABLE 8

| Alloy symbol | Material No. | Gathering degree of plane (%) $S_1$ | $S_2$ | $S_3$ | $S_4$ | $S_5$ | $S_6$ | $S_7$ | $\frac{(S_2+S_4+S_6)}{(S_1+S_3+S_5+S_7)}$ | Crystal grain size in the thickness direction of alloy sheet (μm) |
|---|---|---|---|---|---|---|---|---|---|---|
| C | 21 | 2 | 75 | 6 | 3 | 8 | 4 | 2 | 4.56 | 9.7 |
| B | 22 | 3 | 72 | 6 | 3 | 10 | 4 | 2 | 3.76 | 11.2 |
| A | 23 | 2 | 74 | 6 | 3 | 9 | 4 | 2 | 4.26 | 8.1 |
| B | 24 | 1 | 90 | 3 | 1 | 3 | 1 | 1 | 11.50 | 11.2 |
| C | 25 | 0 | 87 | 6 | 2 | 1 | 1 | 1 | 11.50 | 9.7 |
| B | 26 | 0 | 86 | 8 | 3 | 1 | 1 | 1 | 9.00 | 11.2 |
| A | 27 | 0 | 73 | 12 | 9 | 1 | 2 | 3 | 5.25 | 6.9 |
| C | 28 | 1 | 85 | 6 | 2 | 3 | 2 | 1 | 8.09 | 9.7 |
| A | 29 | 2 | 70 | 3 | 2 | 12 | 7 | 4 | 3.76 | 5.0 |
| B | 30 | 1 | 93 | 2 | 1 | 1 | 1 | 1 | 19.00 | 11.2 |
| A | 31 | 5 | 58 | 5 | 3 | 14 | 8 | 7 | 2.23 | 5.0 |
| B | 32 | 0 | 91 | 4 | 1 | 2 | 1 | 1 | 13.29 | 11.2 |
| B | 33 | 1 | 80 | 9 | 3 | 3 | 2 | 2 | 5.67 | 11.2 |
| C | 34 | 1 | 51 | 24 | 10 | 4 | 5 | 5 | 1.94 | 2.4 |
| A | 35 | 0 | 59 | 21 | 9 | 3 | 4 | 4 | 2.57 | 6.9 |
| A | 36 | 0 | 83 | 9 | 5 | 1 | 1 | 1 | 8.10 | 8.1 |
| C | 37 | 2 | 53 | 23 | 9 | 4 | 4 | 5 | 1.94 | 9.7 |
| A | 38 | 0 | 50 | 24 | 13 | 4 | 5 | 4 | 2.13 | 8.1 |
| B | 39 | 1 | 88 | 2 | 2 | 3 | 3 | 1 | 15.60 | 11.2 |
| C | 40 | 1 | 90 | 2 | 3 | 1 | 2 | 1 | 19.0 | 9.7 |

TABLE 9

| Alloy symbol | Material No. | Gathering degree of plane (%) $S_1$ | $S_2$ | $S_3$ | $S_4$ | $S_5$ | $S_6$ | $S_7$ | $\frac{(S_2+S_4+S_6)}{(S_1+S_3+S_5+S_7)}$ | Crystal grain size in the thickness direction of alloy sheet (μm) |
|---|---|---|---|---|---|---|---|---|---|---|
| I | 46 | 0 | 91 | 3 | 2 | 1 | 2 | 1 | 1.78 | 11.0 |
| J | 47 | 1 | 90 | 2 | 2 | 2 | 1 | 2 | 13.29 | 7.1 |
| K | 48 | 1 | 91 | 2 | 2 | 1 | 2 | 1 | 19.00 | 7.0 |
| J | 49 | 1 | 57 | 1 | 2 | 7 | 16 | 16 | 2.85 | 7.1 |
| L | 50 | 2 | 73 | 5 | 4 | 9 | 4 | 3 | 4.26 | 9.7 |
| M | 51 | 1 | 70 | 6 | 3 | 8 | 4 | 8 | 3.35 | 9.6 |
| N | 52 | 2 | 72 | 5 | 3 | 8 | 4 | 6 | 3.76 | 9.7 |

On each of the obtained alloy sheets, a resist pattern was formed, and the etching factor was measured at 135 μm of d1 shown in FIG. 5. The determination of the etching factor was done by etching the alloy sheet in a bath of ferric chloride solution of 45 Baume degree at 40° C. under 2.5 kg/cm$^2$ of spray pressure for 50 sec. of spraying, and by using the equation (1) described before.

The alloy sheets prepared by the same conditions were formed into flat masks by photo-etching. The flat masks were placed on a level block to measure the curving thereof. The quantity of light penetrated through the flat masks was measured by irradiating light, which quantity was divided by the quantity of light penetrated through a flat mask having the same size of a pierced hole with the alloy sheet and being made of conventional low carbon steel to determine the penetration ratio of light.

The surface roughness on the pierced hole surface of the flat masks of the alloy sheets was measured by a non-contact type laser roughness meter. The cut-off value was 0.02 mm, and the tapered portion on the pierced hole surface was removed as a waving component to draw a roughness curve, and the centerline average roughness (Ra) was determined from the curve.

The production of a blurred periphery of a pierced hole was determined by visual observation.

Tables 10, 11, and 12 show the characteristics of materials No. 1 through No. 52, which include the curving (mm) after etching, the surface roughness (centerline average roughness, Ra (μm)) on the pierced hole surface, the penetration ratio of light of the flat mask (as defined before), the production of blurred periphery of a pierced hole (as defined before), and the etching factor.

With the alloy sheets of the materials No. 46 through No. 49, the surface roughness on the pierced hole surface by photo-etching was determined by the procedure described before. These materials were plated with solder to evaluate the solder plating performance.

TABLE 10

| Alloy Symbol | Material No. | Curving after etching (mm) | Surface roughness on pierced hole surface (Ra,μm) | Penetration ratio of light of flat mask | Production of blurred periphery of pierced hole | Etching factor |
|---|---|---|---|---|---|---|
| A | 1 | 10 | 0.90 | 1.00 | B | 2.02 |
| A | 2 | 7 | 0.77 | 1.05 | B | 2.00 |
| A | 3 | 3 | 0.86 | 1.01 | E | 1.93 |
| A | 4 | 15 | 0.60 | 1.10 | B | 2.03 |
| C | 5 | 12 | 0.64 | 1.08 | B | 2.01 |
| C | 6 | 3 | 0.95 | 0.98 | B | 2.02 |
| C | 7 | 3 | 1.11 | 0.92 | B | 2.02 |
| B | 8 | 3 | 1.27 | 0.88 | B | 2.03 |
| B | 9 | 4 | 0.86 | 1.02 | B | 1.97 |
| B | 10 | 3 | 0.88 | 1.01 | B | 1.95 |
| C | 11 | 2 | 0.84 | 1.02 | B | 1.97 |
| A | 12 | 3 | 0.80 | 1.03 | B | 1.96 |
| B | 13 | 3 | 0.79 | 1.03 | B | 1.99 |
| B | 14 | 3 | 0.89 | 1.01 | E | 2.84 |
| B | 15 | 2 | 0.83 | 1.03 | A | 2.06 |
| A | 16 | 2 | 0.73 | 1.05 | A | 2.19 |
| A | 17 | 1 | 0.70 | 1.07 | A | 2.92 |
| B | 18 | 1 | 0.71 | 1.06 | A | 2.04 |
| A | 19 | 2 | 0.72 | 1.05 | A | 2.35 |
| C | 20 | 2 | 0.69 | 1.07 | A | 2.22 |

TABLE 11

| Alloy Symbol | Material No. | Curving after etching (mm) | Surface roughness on pierced hole surface (Ra,μm) | Penetration ratio of light of flat mask | Production of blurred periphery of pierced hole | Etching factor |
|---|---|---|---|---|---|---|
| C | 21 | 1 | 0.65 | 1.08 | A | 2.27 |
| B | 22 | 1 | 0.72 | 1.06 | A | 2.11 |
| A | 23 | 1 | 0.70 | 1.07 | A | 2.41 |
| B | 24 | 2 | 0.43 | 1.15 | A | 2.40 |
| C | 25 | 2 | 0.24 | 1.20 | A | 2.52 |
| B | 26 | 2 | 0.31 | 1.20 | A | 2.31 |
| A | 27 | 1 | 0.49 | 1.13 | A | 2.59 |
| C | 28 | 2 | 0.50 | 1.13 | A | 2.41 |
| A | 29 | 1 | 0.84 | 1.02 | A | 2.79 |
| B | 30 | 2 | 0.80 | 1.04 | A | 2.65 |
| A | 21 | 2 | 0.85 | 1.02 | A | 2.74 |
| B | 32 | 2 | 0.54 | 1.11 | A | 2.46 |
| B | 33 | 1 | 0.52 | 1.12 | A | 2.18 |
| C | 34 | 1 | 0.68 | 1.08 | A | 3.17 |
| A | 35 | 1 | 0.65 | 1.08 | A | 2.49 |
| A | 36 | 1 | 0.35 | 1.17 | A | 2.55 |
| C | 37 | 1 | 0.67 | 1.07 | A | 2.17 |
| A | 38 | 2 | 0.69 | 1.08 | A | 2.33 |
| B | 39 | 1 | 0.53 | 1.13 | B | 2.53 |
| C | 40 | 1 | 0.55 | 1.12 | C | 2.81 |

TABLE 12

| Alloy symbol | Material No. | Curving after etching (mm) | Surface roughness on pierced hole surface (Ra,μm) | Penetration ratio of light of flat mask | Production of blurred periphery of pierced hole | Etching factor | Solder plating performance |
|---|---|---|---|---|---|---|---|
| I | 46 | 1 | 0.55 | — | — | 3.10 | Good |
| J | 47 | 1 | 0.54 | — | — | 2.95 | " |
| K | 48 | 1 | 0.52 | — | — | 3.12 | " |
| J | 49 | 2 | 1.21 | — | — | 2.50 | Poor |
| L | 50 | 1 | 0.63 | 1.07 | A | 2.30 | — |
| M | 51 | 1 | 0.65 | 1.06 | A | 2.35 | — |
| N | 52 | 1 | 0.60 | 1.07 | A | 2.31 | — |

The materials No. 15 through No. 48 and the materials No. 50 through No. 52 which have the value of the gathering degree $S_1$, $S_2$, $S_3$, $S_4$, $S_5$, $S_6$, and $S_7$ of each corresponding plane {111}, {100}, {110}, {311}, {331}, {210}, and {211} and the value of $(S_2+S_4+S_6)/(S_1+S_3+S_5+S_7)$ within the range specified by this invention gave 2 mm or less of curving after etching, which curving is less than that in the Comparative Examples described later. The surface roughness, Ra, on the pierced hole surface of them was 0.90 μm or less, and their penetration ratio of flat mask was 1.0 or higher, which indicates that the light penetrated through the obtained flat masks is brighter than that through the conventional low carbon steel flat masks.

The etching factor of these materials was 2.0 or more, and the production of a blurred periphery of a pierced hole was at a level of raising no problem during practical application.

Contrary to these materials of this invention, the material No. 1 gave the gathering degree, $S_1$, of {111} plane which is more than the upper limit of this invention. The material No. 2 gave the gathering degree, $S_2$, of {100} plane which is less than the lower limit of this invention. The material No. 3 gave the gathering degree, $S_2$, of {100} plane which is more than the upper limit of this invention. The material No. 4 gave the gathering degree, $S_3$, of {110} plane which is more than the upper limit of this invention. The material No. 5 gave the gathering degree, $S_4$, of {311} plane which is more than the upper limit of this invention. Therefore, their curving after etching was 7 mm or more, which level was larger than that of the Examples of the present invention.

The material No. 6 gave the gathering degree, $S_5$, of {331} plane which is more than the upper limit of this invention. The material No. 7 gave the gathering degree, $S_6$, of {210} plane which is more than the upper limit of this invention. The material No. 8 gave the gathering degree, $S_7$, of {211} plane which is more than the upper limit of this invention. Therefore, their surface roughness, Ra, on the pierced hole surface exceeded 0.90 μm, and the penetration ratio of through flat mask was below 1.0, which were poorer than those of Examples for this invention.

The material No. 9 gave the gathering degree, $S_7$, of {211} plane which is less than the lower limit of this invention. The material No. 10 gave the gathering degree, $S_6$, of {210} plane which is less than the lower limit of this invention. The material No. 11 gave the gathering degree, $S_5$, of {331} plane which is less than the lower limit of this invention. The material No. 12 gave the gathering degree, $S_3$, of [110} plane and the gathering degree, $S_4$, of {311 } plane which are less than the lower limit of this invention. The material No. 13 gave the value of $(S_2+S_4+S_6)/(S_1+S_3+S_5+S_7)$ which is less than the lower limit of this invention. Consequently, these materials gave less than 2.0 of etching factor, which level was not sufficient for this invention.

The material No. 14 gave the value of $(S_2+S_4+S_6)/(S_1+S_3+S_5+S_7)$ which is more than the upper limit of this invention, so the material gave increased production of blurred periphery of pierced hole of flat mask compared with the Examples of this invention.

The material No. 49 gave the gathering degree, $S_6$, of {210} plane and the gathering degree, $S_7$, of {211} plane which is more than the upper limit of this invention. Consequently, these materials gave 1.21 of the surface roughness, Ra, on pierced hole surface, which was rougher than that in Examples of the present invention.

The material No. 3 gave the gathering degree, $S_4$, of {311} plane and the gathering degree, $S_6$, of {210} plane which is less than the lower limit of this invention, so the etching factor of the material was less than 2.0, which value was inferior to that of the Examples of this invention.

As described above, the control of the values of gathering degree, $S_1$, $S_2$, $S_3$, $S_4$, $S_5$, $S_6$, and $S_7$, of the corresponding plane {111}, {100}, {110}, {311}, {331}, {210}, and {211}, a the value of $(S_2+S_4+S_6)/(S_1+S_3+S_5+S_7)$ within the range specified by this invention decreases the curving after etching, decreases the surface roughness, Ra, on a pierced hole surface, increases the quantity of the penetration ratio of light through a flat mask, increases the etching factor, and reduces the production of a blurred periphery of a pierced hole.

Furthermore, the control of crystal grain size in the thickness direction of alloy sheet within the range specified by this invention further increases the etching factor.

The detailed description of this invention given above used a flat mask as an example. Nevertheless, the alloy sheets of this invention can be applied to materials, other than flat masks, for examples electronic devices which are subjected to etching.

What is claimed is:

1. An Fe—Ni alloy sheet which is etched to produce a pierced hole surface consisting essentially of 34 to 52 wt. % Ni and the balance being Fe;

said Fe—Ni alloy sheet having gathering degrees of {331}, {210}, {211}, {111}, {100}, {110} and {311} planes on a surface thereof;

the gathering degree of the {331} plane being 14% or less, the gathering degree of the {210} plane being 1 to 14%, the gathering degree of the {211} plane being 1 to 14%, the gathering degree of the {111} plane being 1 to 10%, the gathering degree of the {100} plane being 50 to 94%, the gathering degree of the {110} plane being 1 to 24%, and the gathering degree of the {311} plane being 1 to 14%, each of said gathering degrees of said planes being calculated by dividing a relative X-ray intensity ratio of each of the {331}, {210}, {211}, {111}, {100}, {110} and {311} diffraction planes by a sum of relative X-ray intensity ratios of the {331}, {111}, {100}, {110}, {311}, {210} and {211} diffraction planes;

a ratio of the gathering degree of the {210} plane to the gathering degrees of the {331} and {211} planes, which is {210}/({331}+{211}) being 0.2 to 1, said Fe—Ni alloy sheet having an average crystal grain size of 10 μm or less in a thickness direction of the Fe—Ni alloy sheet, said Fe—Ni alloy sheet prior to being etched is annealed at a temperature of 910° to 990° C., said Fe—Ni alloy sheet having an etching factor of 1.8 or higher, said Fe—Ni alloy sheet having a surface roughness, Ra, of 0.9 μm or less, said Fe—Ni alloy sheet having a penetration ratio of light of 1.0 or more, and said Fe—Ni alloy sheet having an average thermal expansion coefficient of no more than $2.0\times(1/10^6)$/°C. at a temperature range of 30° to 100° C.

2. The Fe—Ni alloy sheet of claim 1, wherein said average crystal grain size is 6 μm or less.

3. The Fe—Ni alloy sheet of claim 1, wherein said ratio of gathering degrees is from 0.25 to 0.6.

4. The Fe—Ni alloy sheet of claim 1, wherein the Ni is in an amount of 35 to 37 wt. %.

5. In a shadow mask comprising an alloy sheet, wherein the improvement comprises the alloy sheet being a Fe—Ni alloy sheet according to claim 1, said Fe—Ni alloy sheet consisting essentially of 34 to 38 wt. % Ni and the balance being Fe.

6. In an integrated circuit lead frame comprising an alloy sheet, wherein the improvement comprises the alloy sheet being a Fe—Ni alloy sheet according to claim 1, said Fe—Ni alloy sheet consisting essentially of 38 to 52 wt. % Ni and the balance being Fe.

7. The Fe—Ni alloy sheet of claim 1, wherein the ratio of {210}/{331}+{211} is 0.25 to 0.6.

8. A Fe—Ni—Co alloy sheet which is etched to have a pierced hole surface, said Fe—Ni—Co alloy sheet consisting essentially of 27 to 38 wt. % Ni, % 1 to 20 wt. % Co and the balance being Fe;

said Fe—Ni—Co alloy sheet having gathering degrees of {331}, {210}, {211}, {111}, {100}, {110} and {311} planes on a surface thereof, the gathering degree of the {331} plane being 14% or less, the gathering degree of the {210} plane being 1 to 14%, the gathering degree of the {211} plane being 1 to 14%, the gathering degree of the {111} plane being 1 to 10%, the gathering degree of the {100} plane being 50 to 94%, the gathering degree of the {110} plane being 1 to 24%, and the gathering degree of the {311} plane being 1 to 14%, each of said gathering degrees of said planes being calculated by dividing a relative X-ray intensity ratio of each of the {331}, {210}, {211}, {111}, {100}, {110} and {311} diffraction planes by a sum of relative X-ray intensity ratios of the {331}, {210}, {211}, {111}, {100}, {110} and {311} diffraction planes; and a ratio of the gathering degree of the {210} plane to the gathering degrees of the {331} and {211} planes, which is {210}/({331}+{211}) being 0.2 to 1;

said Fe—Ni—Co alloy sheet having an average crystal grain size of 10 μm or less in a thickness direction of the alloy sheet, said Fe—Ni—Co alloy sheet prior to being etched is annealed at a temperature of 910° to 990° C., said Fe—Ni—Co alloy sheet having an etching factor of 1.8 or higher, said Fe—Ni—Co alloy sheet having a surface roughness, Ra, of 0.9 μm or less, said Fe—Ni—Co alloy sheet having a penetration ratio of light of 1.0 or more, and said Fe—Ni—Co alloy sheet having an average thermal expansion coefficient of no more than $2.0\times(1/10^6)$/°C. at a temperature range of 30° to 100° C.

9. In a shadow mask comprising an alloy sheet, wherein the improvement comprises the alloy sheet being a Fe—Ni—Co alloy sheet according to claim 8, said Fe—Ni—Co alloy sheet consisting essentially of 28 to 38 wt. % Ni and 1 to 7 wt. % Co and the balance being Fe.

10. In an integrated circuit lead frame comprising an alloy sheet, wherein the improvement comprises the alloy sheet being a Fe—Ni—Co alloy sheet according to claim 8, said Fe—Ni—Co alloy sheet consisting essentially of 27 to 32 wt. % Ni and 1 to 20 wt. % Co and the balance being Fe.

11. The Fe—Ni—Co alloy sheet of claim 8, wherein the ratio of {210}/{331}+{211} is 0.25 to 0.6.

12. A Fe—Ni—Cr alloy sheet which is etched to have a pierced hole surface, said Fe—Ni—Cr alloy sheet consisting essentially of 34 to 52 wt. % Ni, 3 wt. % or less Cr and the balance being Fe;

said Fe—Ni—Cr alloy sheet having gathering degrees of {331}, {210}, {211}, {111}, {100}, {110} and {311} planes on a surface thereof, the gathering degree of the {331} plane being 14% or less, the gathering degree of the {210} plane being 1 to 14%, the gathering degree of the {211} plane being 1 to 14%, the gathering degree of the {111} plane being 1 to 10%, the gathering degree of the {100} plane being 50 to 94%, the gathering degree of the {110} plane being 1 to 24%, and the gathering degree of the {311} plane being 1 to 14%, each of said gathering degrees of said planes being calculated by dividing a relative X-ray intensity ratio of each of the {331}, {210}, {211}, {111}, {100}, {110} and {311} diffraction planes by a sum of relative X-ray intensity ratios of the {331}, {210}, {211}, {111}, {100}, {110} and {311} diffraction planes; and a ratio of the gathering degree of the {210} plane to the gathering degrees of the {331} and {211} planes, which is {210}/({331}+{211}) being 0.2 to 1;

said Fe—Ni—Cr alloy sheet having an average crystal grain size of 10 μm or less in a thickness direction of the alloy sheet, said Fe—Ni—Cr alloy sheet prior to being etched is annealed at a temperature of 910° to 990° C., said Fe—Ni—Cr alloy sheet having an etching factor of 1.8 or higher, said Fe—Ni—Cr alloy sheet having a surface roughness, Ra, of 0.9 μm or less, said Fe—Ni—Cr alloy sheet having a penetration ratio of light of 1.0 or more, and said Fe—Ni—Cr alloy sheet having an average thermal expansion coefficient of no more than $2.0\times(1/10^6)$/°C. at a temperature range of 30° to 100° C.

13. The Fe—Ni—Cr alloy sheet of claim 12, wherein the ratio of {210}/{331}+{211} is 0.25 to 0.6.

14. An Fe—Ni alloy sheet which is etched to have a pierced hole surface, said Fe—Ni alloy sheet consisting essentially of 34 to 52 wt. % Ni and the balance being Fe;

said alloy sheet having gathering degrees of planes {111}, {100}, {110}, {311}, {210}, and {211} planes on a surface thereof;

the gathering degree $S_1$ of the {111} plane being 1 to 10%, the gathering degree $S_2$ of the {100} plane being 50 to 94%, the gathering degree $S_3$ of the {110} plane being 1 to 24%, the gathering degree $S_4$ of the {311} plane being 1 to 14%, the gathering degree $S_5$ of the {331} plane being 1 to 14%, the gathering degree $S_6$ of the {210} plane being 1 to 14%, and the gathering degree $S_7$ of the {211} plane being 1 to 14%;

each of said gathering degrees of planes being calculated by dividing a relative X-ray intensity ratio of each of the {111}, {100}, {110}, {331}, {210} and {211} diffraction planes by a sum of relative X-ray intensity ratios of the {111}, {100}, {110}, (311}, {331}, {210}0 and {211}0 diffraction planes; and a ratio of the gathering degrees of planes, which is $(S_2+S_4+S_6)/(S_1+S_3+S_5+S_7)$ being 0.8 to 20:

said Fe—Ni alloy sheet having an average crystal grain size of 10 μm or less in a thickness direction of the alloy sheet, said Fe—Ni alloy sheet prior to being etched is annealed at a temperature of 910° to 990° C., said Fe—Ni alloy sheet having an etching factor of 1.8 or higher, said Fe—Ni alloy sheet having a surface roughness, Ra, of 0.9 μm or less, said Fe—Ni alloy sheet having a penetration ratio of light of 1.0 or more, and said Fe—Ni alloy sheet having an average thermal expansion coefficient of no more than $2.0\times(1/10^6)$/°C. at a temperature range of 30° to 100° C.

15. The Fe—Ni alloy sheet of claim 14, wherein said average crystal grain size is 6 μm or less.

16. The Fe—Ni alloy sheet of claim 14, wherein said ratio of gathering degrees is from 1.5 to 11.5.

17. The Fe—Ni alloy sheet of claim 14, wherein the ratio of $(S_2+S_4+S_6)/(S_1+S_3+S_5+S_7)$ is 1.5 to 11.5.

18. A Fe—Ni—Co alloy sheet which is etched to have a pierced hole surface, said Fe—Ni—Co alloy sheet consisting essentially of 28 to 38 wt. % Ni, 20 wt. % or less Co and the balance being Fe;

said Fe—Ni—Co alloy sheet having gathering degrees of {111}, {100}, {110}, {311}, {331}, {210}, and {211} planes on a surface thereof;

the gathering degree $S_1$ of the {111} plane being 1 to 10%, the gathering degree $S_2$ of the {100} plane being 50 to 94%, the gathering degree $S_3$ of the {110} plane being 1 to 24%, the gathering degree $S_4$ of the {311} plane being 1 to 14%, the gathering degree $S_5$ of the {331} plane being 1 to 14%, the gathering degree $S_6$ of the {210} plane being 1 to 14%, and the gathering degree $S_7$ of the {211} plane being 1 to 14%, each of said gathering degrees of said planes being calculated by means of dividing a relative X-ray intensity ratio of each of the {331}, {210}, {211}, {111}, {100}, {110} and {{311} diffraction planes by a sum of relative X-ray intensity ratios of {111}, {100}, {110}, {311}, {331}, {210} and {211} diffraction planes; and a ratio of the gathering degrees of the planes, which $(S_2+S_4+S_6)/(S_1+S_3+S_5+S_7)$ being 0.8 to 20;

said Fe—Ni—Co alloy sheet having an average crystal grain size of 10 μm or less in a thickness direction of the alloy sheet, said Fe—Ni—Co alloy sheet prior to being etched is annealed at a temperature of 910° to 990° C., said Fe—Ni—Co alloy sheet having an etching factor of 1.8 or higher, said Fe—Ni—Co alloy sheet having a surface roughness, Ra, of 0.9 μm or less, said Fe—Ni—Co alloy sheet having a penetration ratio of light of 1.0 or more, and said Fe—Ni—Co alloy sheet having an average thermal expansion coefficient of no more than $2.0\times(1/10^6)$/°C. at a temperature range of 30° to 100° C.

19. A Fe—Ni—Cr alloy sheet which is etched to produce a pierced hole surface, said Fe—Ni—Cr alloy sheet consisting essentially of 34 to 52 wt. % Ni, 3 wt. % or less Cr and the balance being Fe;

said Fe—Ni—Cr alloy sheet having gathering degrees of {111}, (100}, {110}, {311}, {331}, {210} and (211} planes on a surface thereof;

the gathering degree $S_1$ of the {111} plane being 1 to 10%, the gathering degree $S_2$ of the {100} plane being 50 to 94%, the gathering degree $S_3$ of the {110} plane being 1 to 24%, the gathering degree $S_4$ of the {311} plane being 1 to 14%, the gathering degree $S_5$ of the {331} plane being 1 to 14%, the gathering degree $S_6$ of the {210} plane being 1 to 14%, and the gathering degree $S_7$ of the {211} plane being 1 to 14%, each of said gathering degrees of said planes being calculated by dividing a relative X-ray intensity ratio of each of {331}, {210}, {211}, {111}, {100}, {110} and {311} diffraction planes by a sum of relative X-ray intensity ratios of the {111}, {100}, {110}, (311}, {331}, {210} and {211} diffraction planes; and a ratio of the gathering degrees of the planes, which is $(S_2+S_4+S_6)/(S_1+S_3+S_5+S_7)$ being 0.8 to 20;

said Fe—Ni—Cr alloy sheet having an average crystal grain size of 10 μm or less in a thickness direction of the alloy sheet, said Fe—Ni—Cr alloy sheet prior to being etched is annealed at a temperature of 910° to 990° C., said Fe—Ni—Cr alloy sheet having an etching factor of 1.8 or higher, said Fe—Ni—Cr alloy sheet having a surface roughness, Ra, of 0.9 μm or less, said Fe—Ni—Cr alloy sheet having a penetration ratio of light of 1.0 or more, and said Fe—Ni—Cr alloy sheet having an average thermal expansion coefficient of no more than $2.0\times(1/10^6)/°C.$ at a temperature range of 30° to 100° C.

20. A Fe—Ni—Co—Cr alloy sheet which is etched to have a pierced hole surface, said Fe—Ni—Co—Cr alloy sheet consisting essentially of 28 to 38 wt. % Ni, 20 wt. % or less Co, 3 wt. % or less Cr and the balance being Fe;

said alloy sheet having gathering degrees of {111}, {100}, {110}, {311}, {331}, {210} and {211} planes on a surface thereof;

the gathering degree $S_1$ of the {111} plane being 1 to 10%, the gathering degree $S_2$ of the {100} plane being 50 to 94%, the gathering degree $S_3$ of the {110} plane being 1 to 24%, the gathering degree $S_4$ of the {311} plane being 1 to 14%, the gathering degree $S_5$ of the {331} plane being 1 to 14%, the gathering degree $S_6$ of the {210} plane being 1 to 14%, and the gathering degree $S_7$ of the {211} plane being 1 to 14%, each of said gathering degrees of said planes being calculated by dividing a relative X-ray intensity ratio of each of {331}, {210}, {211}, {111}, {100}, {110} and {311} diffraction planes by a sum of relative X-ray intensity ratios of the {111}, {100}, {110}, {311}, {331}, {210} and {211} diffraction planes; and a ratio of the gathering degrees of the planes, which is $(S_2+S_4+S_6)/(S_1+S_3+S_5+S_7)$ being 0.8 to 20;

said Fe—Ni—Co—Cr alloy sheet having an average crystal grain size of 10 μm or less in a thickness direction of the alloy sheet, said Fe—Ni—Co—Cr alloy sheet prior to being etched is annealed at a temperature of 910° to 990° C., said Fe—Ni—Co—Cr alloy sheet having an etching factor of 1.8 or higher, said Fe—Ni—Co—Cr alloy sheet having a surface roughness, Ra, of 0.9 μm or less, said Fe—Ni—Co—Cr alloy sheet having a penetration ratio of light of 1.0 or more, and said Fe—Ni—Co—Cr alloy sheet having an average thermal expansion coefficient of no more than $2.0\times(1/10^6)/°$ C. at a temperature range of 30° to 100°C.

* * * * *